US005984788A

United States Patent [19]

Lebensfeld et al.

[11] Patent Number: 5,984,788

[45] Date of Patent: Nov. 16, 1999

[54] INTERACTIVE TOY SHOOTING GAME HAVING A TARGET WITH A FEELABLE OUTPUT

[75] Inventors: Steven Lebensfeld, Laurel Hollow; Frank Landi, Great Neck; Carmine Russo, West Islip, all of N.Y.; David Chu Ki Kwan, Hong Kong, The Hong Kong Special Administrative Region of the People's Republic of China

[73] Assignee: Toymax Inc., Plainview, N.Y.

[21] Appl. No.: 08/871,248

[22] Filed: Jun. 9, 1997

[51] Int. Cl.[6] ..... A63F 9/24

[52] U.S. Cl. ..... 463/51

[58] Field of Search ..... 463/2, 5, 50–53, 463/56, 30, 31, 36, 39–42, 46; 434/20–22, 24, 307 R; 446/175, 397, 401, 404–405, 436–437, 441–443, 473, 475; 273/148 B, 349; 222/78–79

[56] References Cited

U.S. PATENT DOCUMENTS

| | | | |
|---|---|---|---|
| 2,404,653 | 7/1946 | Plebanek . | |
| 2,957,693 | 10/1960 | Ross . | |
| 3,202,425 | 8/1965 | Van Hennik . | |
| 3,220,732 | 11/1965 | Pincus . | |
| 3,499,650 | 3/1970 | Lemelson . | |
| 3,508,751 | 4/1970 | Meyer et al. . | |
| 3,549,147 | 12/1970 | Katter et al. . | |
| 3,795,400 | 3/1974 | Glass et al. . | |
| 3,870,305 | 3/1975 | Harclerode . | |
| 3,960,380 | 6/1976 | Yokoi . | |
| 3,995,376 | 12/1976 | Kimble et al. . | |
| 4,164,081 | 8/1979 | Berke . | |
| 4,171,811 | 10/1979 | Meyer et al. . | |
| 4,266,776 | 5/1981 | Goldfarb . | |
| 4,267,606 | 5/1981 | Stelter et al. . | |
| 4,375,106 | 2/1983 | Voll . | |
| 4,426,662 | 1/1984 | Skerlos et al. . | |
| 4,487,583 | 12/1984 | Brucker et al. | 463/52 |
| 4,533,144 | 8/1985 | Juarez et al. . | |
| 4,586,715 | 5/1986 | Scolari et al. . | |
| 4,629,427 | 12/1986 | Gallagher . | |
| 4,695,058 | 9/1987 | Carter, III | 463/5 |
| 4,754,133 | 6/1988 | Bleich . | |
| 4,772,028 | 9/1988 | Rockhold et al. | 463/52 |
| 4,781,593 | 11/1988 | Birge et al. . | |
| 4,802,675 | 2/1989 | Wong et al. . | |
| 4,844,475 | 7/1989 | Saffer et al. . | |
| 4,890,838 | 1/1990 | Rudell et al. . | |
| 4,898,391 | 2/1990 | Kelly et al. . | |
| 4,900,020 | 2/1990 | Rehkepmer et al. . | |
| 4,903,864 | 2/1990 | Sirhan . | |
| 4,931,028 | 6/1990 | Jaeger et al. . | |

(List continued on next page.)

FOREIGN PATENT DOCUMENTS

| | | | |
|---|---|---|---|
| 0479422 | 8/1992 | European Pat. Off. | A63F 9/22 |

OTHER PUBLICATIONS

Hasbro Survivor Shot Description in IDS dated Apr. 28, 1998 and a photocopy of a product photograph.

Five page brochure of Yes! Entertainment Corp. (1996 Copyright Notice) of T.R.A.P. products.

*Primary Examiner*—Jessica J. Harrison
*Assistant Examiner*—Mark A. Sager
*Attorney, Agent, or Firm*—Brown Raysman Millstein Felder & Steiner LLP

[57] ABSTRACT

The invention provides a toy light projector or light gun and player-worn and self-propelled toy targets which detect light emitted by a toy light gun, and a toy shooting game which includes at least one toy light gun, and at least one toy target. The game is played by a player attempting to "hit" a target which provides a feelable output upon detecting light projected by the gun, e.g., an ejection or release of a material, object, vibration, electrical shock, etc. The output is intended to be received and felt (other than by sight or sound) by a person playing the game. In the preferred embodiments, the target squirts water or bursts a water-filled balloon when a hit is detected or after a given number of hits is detected. Audio/visual effects may also be provided in response to hits.

27 Claims, 20 Drawing Sheets

U.S. PATENT DOCUMENTS

| | | | |
|---|---|---|---|
| 4,991,847 | 2/1991 | Rudell et al. . | |
| 5,029,872 | 7/1991 | Sassak . | |
| 5,114,154 | 5/1992 | Sellner | 463/5 |
| 5,127,657 | 7/1992 | Ikezawa et al. | 463/5 |
| 5,158,212 | 10/1992 | Sirhan . | |
| 5,253,068 | 10/1993 | Crook et al. . | |
| 5,320,362 | 6/1994 | Bear et al. | 463/51 |
| 5,375,847 | 12/1994 | Fromm et al. . | |
| 5,382,026 | 1/1995 | Harvard et al. | 463/5 |
| 5,401,025 | 3/1995 | Smith et al. . | |
| 5,437,463 | 8/1995 | Fromm . | |
| 5,474,486 | 12/1995 | Chilton et al. . | |
| 5,552,917 | 9/1996 | Darbee et al. . | |
| 5,577,962 | 11/1996 | Kounoe et al. . | |
| 5,656,907 | 8/1997 | Chainani et al. . | |
| 5,672,108 | 9/1997 | Lam et al. . | |
| 5,741,185 | 4/1998 | Kwan et al. | 463/51 |
| 5,785,592 | 7/1998 | Jacobsen | 463/7 |

INTERACTIVE TOY SHOOTING GAME HAVING A TARGET WITH A FEELABLE OUTPUT

BACKGROUND OF THE INVENTION

The invention disclosed herein relates to an interactive toy shooting game played by radiating energy, e.g., light, towards a target which detects appropriately directed radiated energy and in response thereto provides an output that a person can feel, e.g., an ejection or release of a material, object, vibration, electrical shock, etc. The output is intended to be received and felt (other than by sight or sound) by a person playing the game. The target may be carried by a player or by a self-propelled or stationary device. The game may also provide audio and/or visual effects associated with the detection of radiation and/or the feelable output. The invention extends the play value of the toy shooting game disclosed in copending application Ser. No. 08/795,895, filed Feb. 5, 1997, the entire disclosure of which is incorporated herein by reference.

Toy shooting games played by shooting some form of light and detecting when the shot light strikes a target typically include a light emitter and a light detector. The light detector may be located with the target and detect light impinging on the target, or the light detector may be provided with the light emitter to detect light reflected from a reflector provided with the target. Many remote control applications, including remote control of consumer electronics devices and toys, use transmitted and detected light. Some of the above toys and remote control applications disclose pulsing, modulating and/or coding the light which may be infrared light. See, for example, U.S. Pat. Nos. 3,220,732, 3,499,650, 3,870,305, 3,995,376, 4,164,081, 4,171,811, 4,266,776, 4,267,606, 4,586,715, 4,629,427, 4,754,133, 4,781,593, 4,802,675, 4,898,391, 4,375,106, 4,426,662, 4,931,028, 5,029,872, 5,375,847, 5,437,463, 5,552,917 and 5,577,962.

Yes! Entertainment Corporation of Pleasanton, Calif. currently sells a line of remote activated "prank" devices which squirt water, burst a water-filled balloon, release insect resembling figures and emit sounds intended to embarrass or annoy. The devices each include a remote transmitter and a remote receiver. The transmitter and receiver do not operate as a shooting game since the receiver may be activated by the remote from anywhere within the proximity range of the device, apparently even through interior walls. Thus, operation is not substantially limited to line-of-sight, and these prank device are not shooting games.

U.S. Pat. No. 5,474,486 discloses a remotely activated water squirting toy vehicle. The toy vehicle is not a shooting game and is activated similar to remotely-controlled toy vehicles.

U.S. Pat. Nos. 4,903,864 and 5,158,212 disclose toys which include an electric pump for squirting water, and U.S. Pat. Nos. 3,795,400, 4,890,838, 4,900,020 and 4,991,847 disclose toys which include a water-filled balloon that is burst by gravity or a motor-driven mechanism.

None of the toys and remote control devices described above or in the patents cited above provide an output that a person can feel when a target is struck by directed radiation in a toy shooting game.

OBJECTS AND SUMMARY OF THE INVENTION

It is an object of the invention disclosed herein to extend the play action of a toy shooting game by providing the game with an output that a person playing the game can feel, i.e., a feelable output as described herein and equivalents, in response to a target being struck by directed, radiated light.

It is another object of the invention to provide such a toy shooting game in which the feelable output is a release or ejection of a material, or object, vibration, electrical shock, etc., particularly the release or ejection of water.

The above and other objects are achieved by the invention disclosed herein, which comprises, individually and in combination, a toy energy radiator and a toy energy receptor or detector having the structures described herein and equivalents thereof which perform the functions described herein and equivalents thereof. In the preferred embodiments, light energy is used. However, other forms of appropriate radiated energy may be used to achieve functions described herein, and the invention is intended to encompass such other forms of radiated energy, such as electro-magnetic and sound energy. Light energy may be any appropriate light of wave length or lengths, visible and invisible to the human eye.

The toy energy radiator, the toy energy receptor or detector and the combination may be as described in application Ser. No. 08/798,895, with the receptor or detector, or a device coupled thereto, providing the feelable output in addition to or in lieu of one or more of the outputs described in application Ser. No. 08/798,895.

A toy shooting game according to the invention comprises a toy radiation projector which projects radiation therefrom generally along a direction in which the radiation projector is pointed, a toy radiation detector which detects radiation projected from the radiation projector substantially only generally along a line of sight from the radiation projector to the radiation detector and provides some indication that the radiation detector has detected radiation from the radiation projector, and a device coupled to the radiation detector which is caused by the radiation detector to provide a feelable output in response to the radiation detector detecting radiation projected from the radiation projector generally along a line of sight from the radiation projector to the radiation detector.

The device may be provided with the detector as a unit, or may be coupled thereto by a physical connection such as cable or conductor, or may be linked by a "wireless" link.

The radiation projector and the radiation detector thus cooperate to function as a shooting game which provides a feelable output when a hit is detected. The radiation may be light or some other form of radiation, as long as the radiation projector and the radiation detector operate on a line-of-sight basis to simulate a shooting game. Line of sight operation may be provided by any suitable structure, and structure for a line-of-sight light operated shooting game is described below. In the preferred embodiments, the radiation is light, and either the optical systems of the projector, a target, or both, or the coding of the light pulses, or both an optical system or systems and coding, are responsible for the line-of-sight operation of the preferred embodiment of the of the toy shooting game described herein.

The radiation detector may cause the device to provide the feelable output each time that the radiation detector detects radiation projected from the radiation projector, or after a predetermined number of detections, or both.

The device may comprise a motor driven by the radiation detector when the radiation detector detects radiation projected from the radiation projector, a pump driven by the electric motor, a liquid storage tank communicated with an input of the pump and a nozzle communicated with an output of the pump. Alternatively, structure may be coupled to the electric motor, or a solenoid positioned to contact and rupture a liquid-filled balloon when moved by the electric motor or solenoid.

In the preferred embodiments, the detector is a light detector, preferably an IR detector, which provides an electrical signal in response to a coded light pulse which causes the device to provide the feelable output. The electrical signal may drive a motor or a solenoid, as described above, or a vibration device, for example. The motor may function to pump water or some other liquid from the toy target, or drive a cam which actuates a plunger device to puncture a liquid- or water-filled balloon, or to disengage a latch to release a material or object. Or a solenoid may actuate the cam or plunger. Alternatively, the feelable output may be provided by a mechanical vibrator which transfers mechanical energy to a wearer of the target or known devices that output a jolt of electrical energy or heat energy, etc.

The motor or plunger may be disposed in a main toy target or an auxiliary toy target described in application Ser. No. 08/798,895, or in a device coupled thereto as described above.

As mentioned in application 08/798,895, light energy is used in the preferred embodiments. Therefore, the invention is described below in connection with light energy with the intention that the invention not be so limited, and that other forms of radiated energy may be used as well. Also, the preferred feelable output is the ejection or release of water. But the invention is not so limited, and the feelable output may be a vibration or a jolt of electrical or heat energy sufficient to be felt by a player wearing a target or in close proximity to a target, and other feelable outputs that will be apparent to those of skill in the art.

BRIEF DESCRIPTION OF THE DRAWINGS

The invention is illustrated in the figures of the accompanying drawings which are meant to be exemplary and not limiting, in which like numerals in the different figures refer to like or corresponding parts, and in which.

DESCRIPTION OF THE PREFERRED EMBODIMENTS

Figure 5:
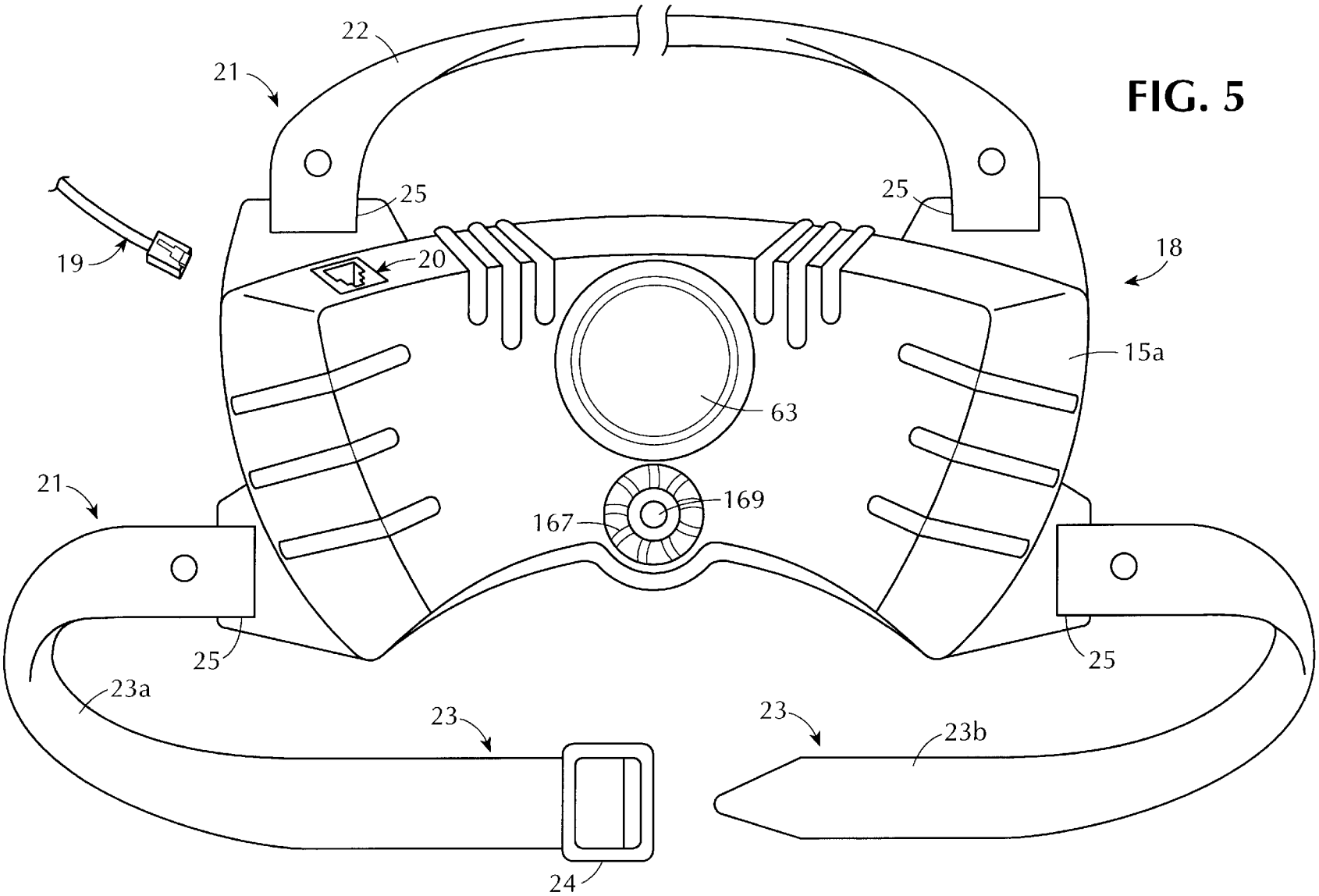
FIG. 5 is a perspective view of another player-worn target described in application Ser. No. 08/798,895, which responds to light from the toy light gun depicted in FIG. 1.
Figure 22:
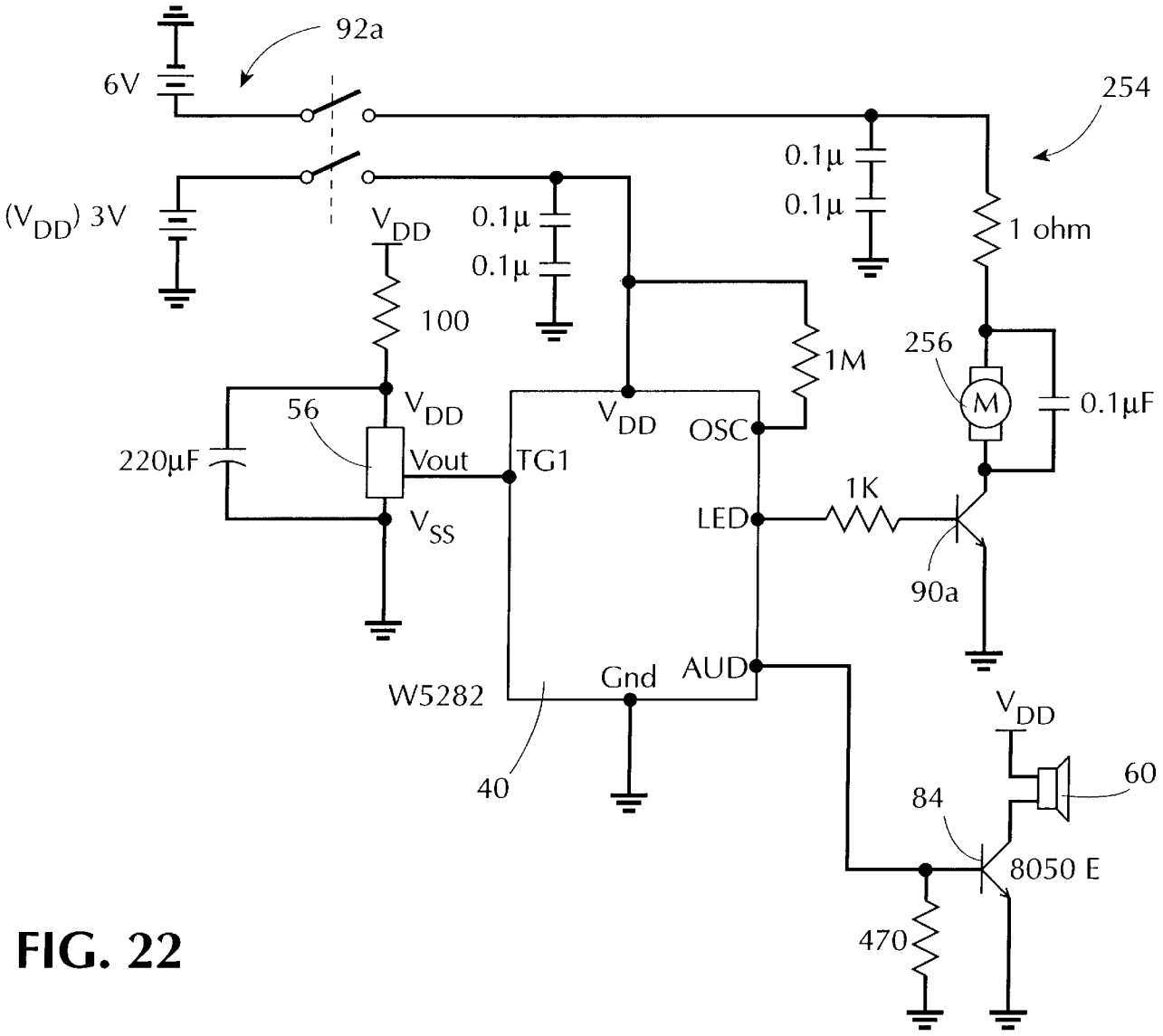
FIG. 22 is a electrical schematic diagram of the target of FIG. 20 which includes a motor.
Figure 23:
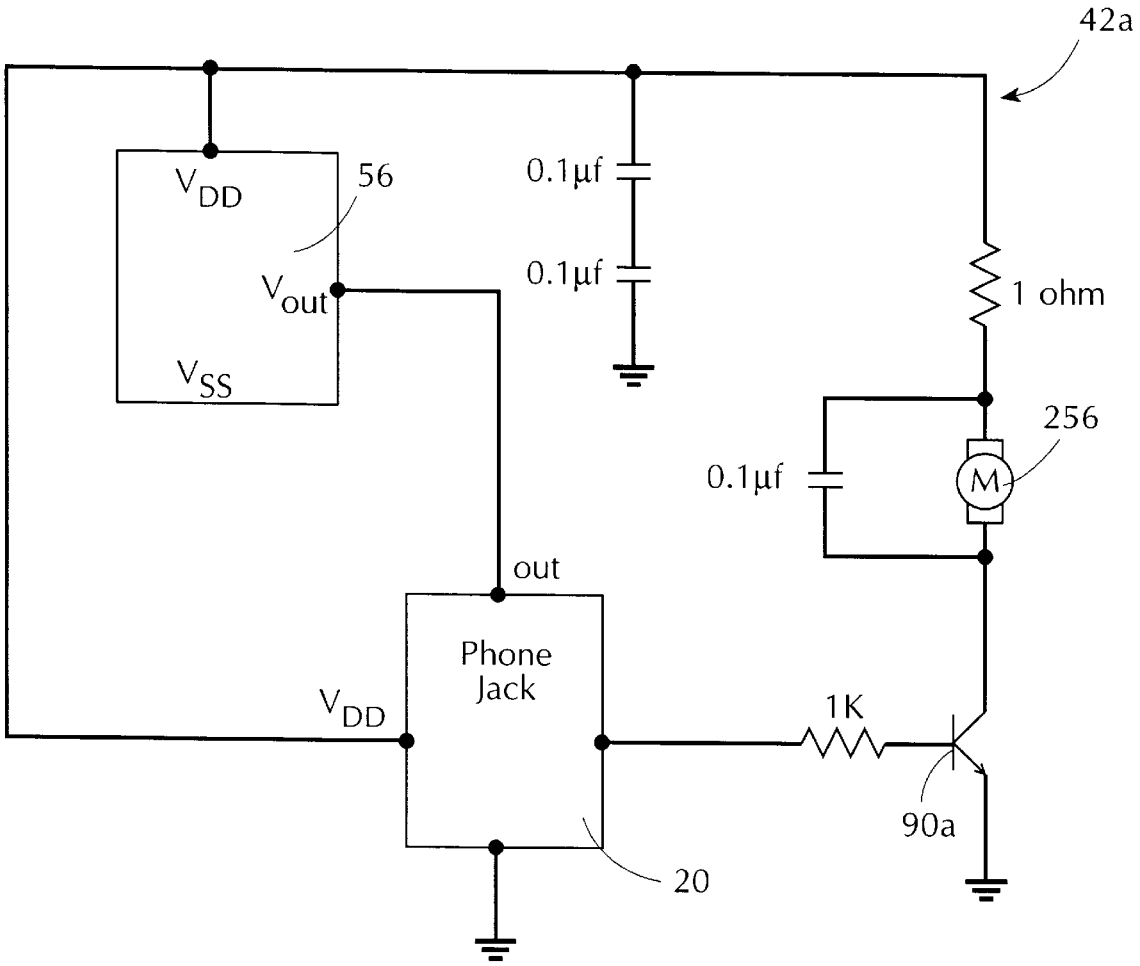
FIG. 23 is an electrical schematic diagram of an auxiliary target similar to the one shown in FIG. 5 but including a motor.

The shooting game disclosed herein includes a toy light projector or light gun 12 configured as a futuristic "ray" gun (FIG. 1), and one or more targets having a feelable output as described herein. In the preferred embodiment, the target is a player-worn target (FIGS. 22 and 23). The target game may include more than one player-worn target for each player, for example one target with a physical output (FIG. 22 or 23 ) and one target without a physical output (FIG. 5).

The targets 22, 23 and 5 are linked by a set of conductors or a wireless link to cooperate and/or share components, for example as described in connection with FIGS. 4 and 5.

The gun 12 and targets 14, 14*a* and 18 disclosed in application 08/798,895 are described below, followed by a description of targets having feelable outputs incorporating the invention.

Toy Shooting Game Without Feelable Output

Figure 2:
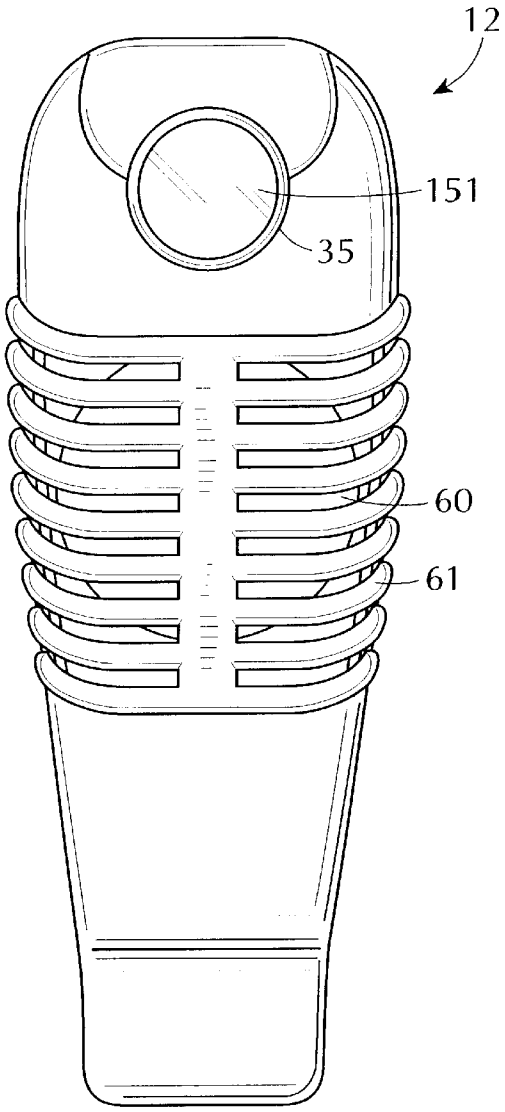
FIG. 2 is a front view of the toy light gun depicted in FIG. 1.
Figure 3:
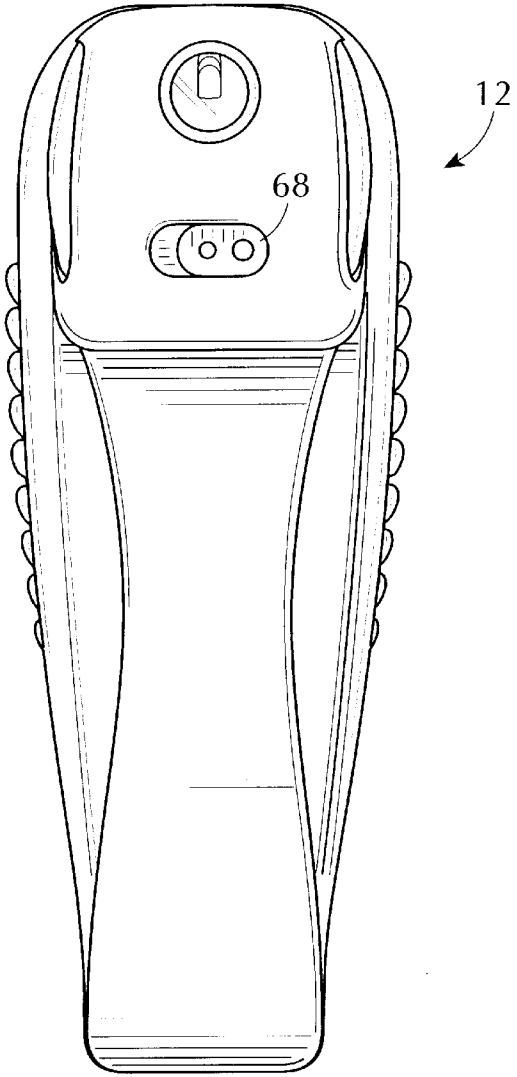
FIG. 3 is a rear view of the toy light gun depicted in FIG. 1.
Figure 6:
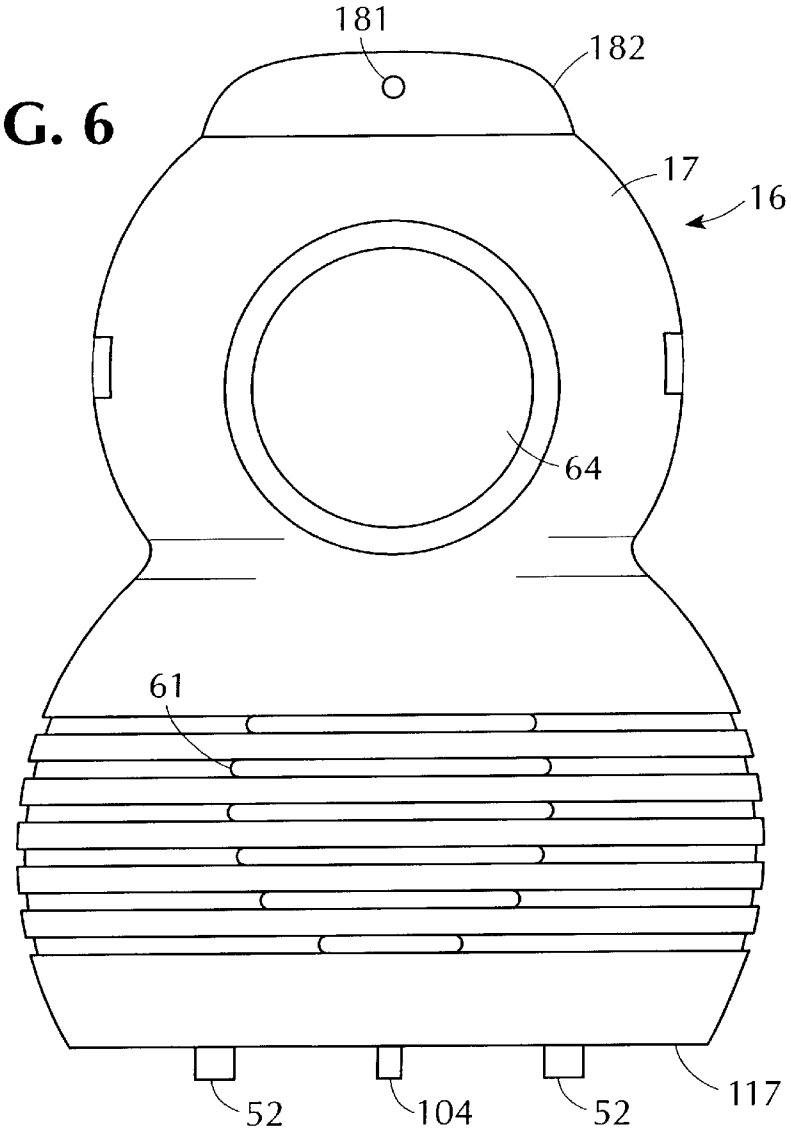
FIG. 6 is a perspective view of a self-propelled target described in application Ser. No. 08/798,895, which responds to light from the toy light gun depicted in FIG. 1.

The shooting game disclosed in application Ser. No. 08/795,895 includes a toy light projector or light gun 12 configured as a futuristic "ray" gun (FIGS. 1–3). and either or both a player-worn target 14 (FIG. 4) or a self-propelled target 16 (FIG. 6). That target game may include more than one player-worn target for each player, and in the preferred embodiment two player worn targets are provided, the player-worn target 14 shown in FIG. 4 and another player-worn target 18 shown in FIG. 5. To enhance play value, the targets 14 and 18 are linked by a set of conductors 19 (FIG. 5) and phone jacks 20 (FIGS. 4 and 5) to cooperate and/or share components, for example, for performing functions including: counting hits, reporting hits and/or other events visually and/or audibly, and/or resetting both targets to start a new game, and/or generating or otherwise supplying the power needed to operate the targets, and/or other functions.

Figure 4:
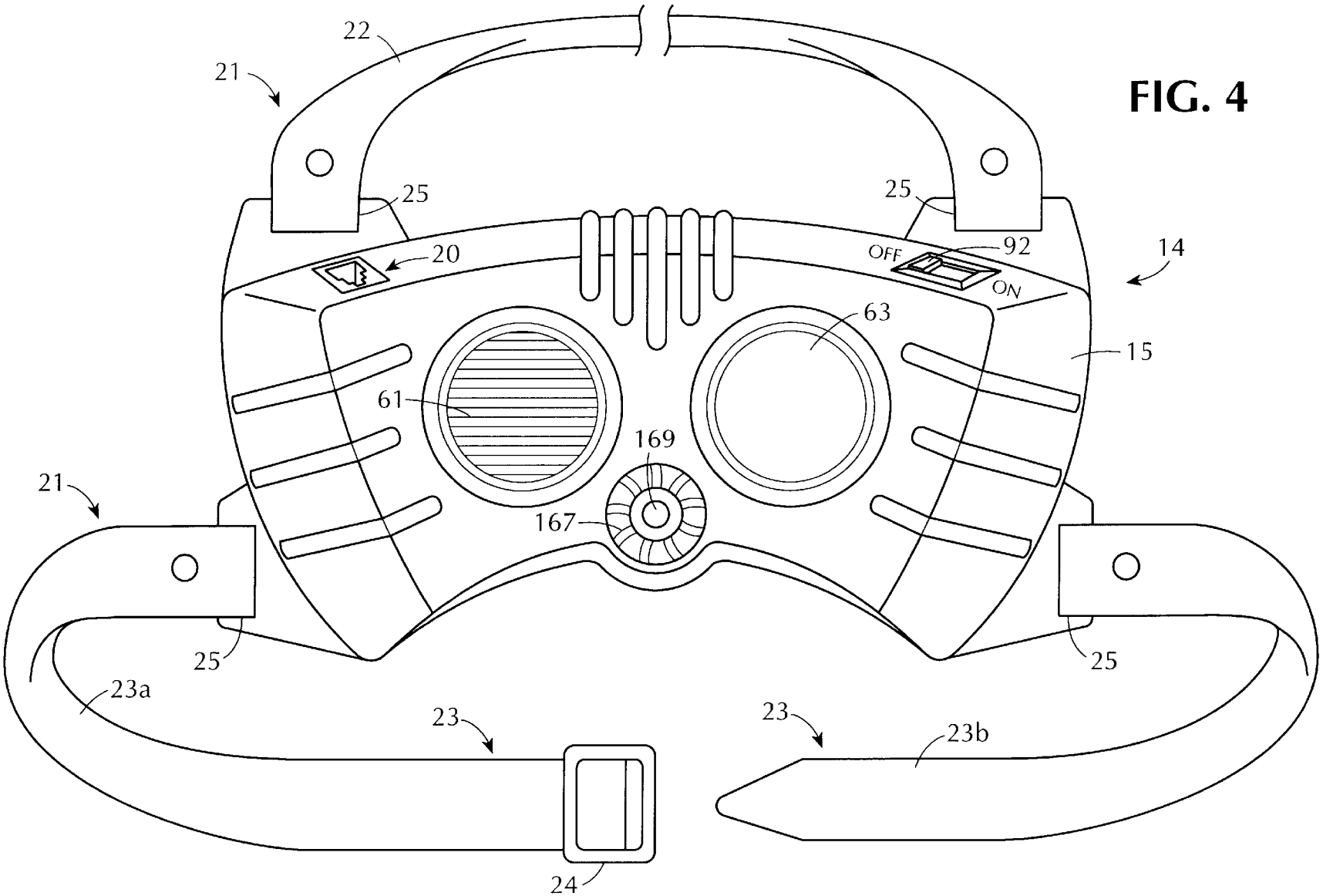
FIG. 4 is a perspective view of a player-worn target described in application Ser. No. 08/798,895, which responds to light from the toy light gun depicted in FIG. 1.

The player-worn targets 14 and 18 shown in FIGS. 4 and 5 each have a housing 15, 15*a* and a strap harness 21 by means of which the respective target may be worn on the chest or back of the player. Each harness 21 comprises a one-piece strap 22 attached to the respective vest target and configured to be worn over the shoulders, and a two-piece strap 23*a*, 23*b* with a buckle 24 attached to the respective vest target and configured to be worn around the back. The straps 22, 23*a*, 23*b* are attached to the respective targets through loops 25 on the respective housings 15, 15*a* of the targets. Since both player-worn targets 14 and 18 are worn in a vest-like manner, they are referred to below as "vest" targets.

Figure 7:
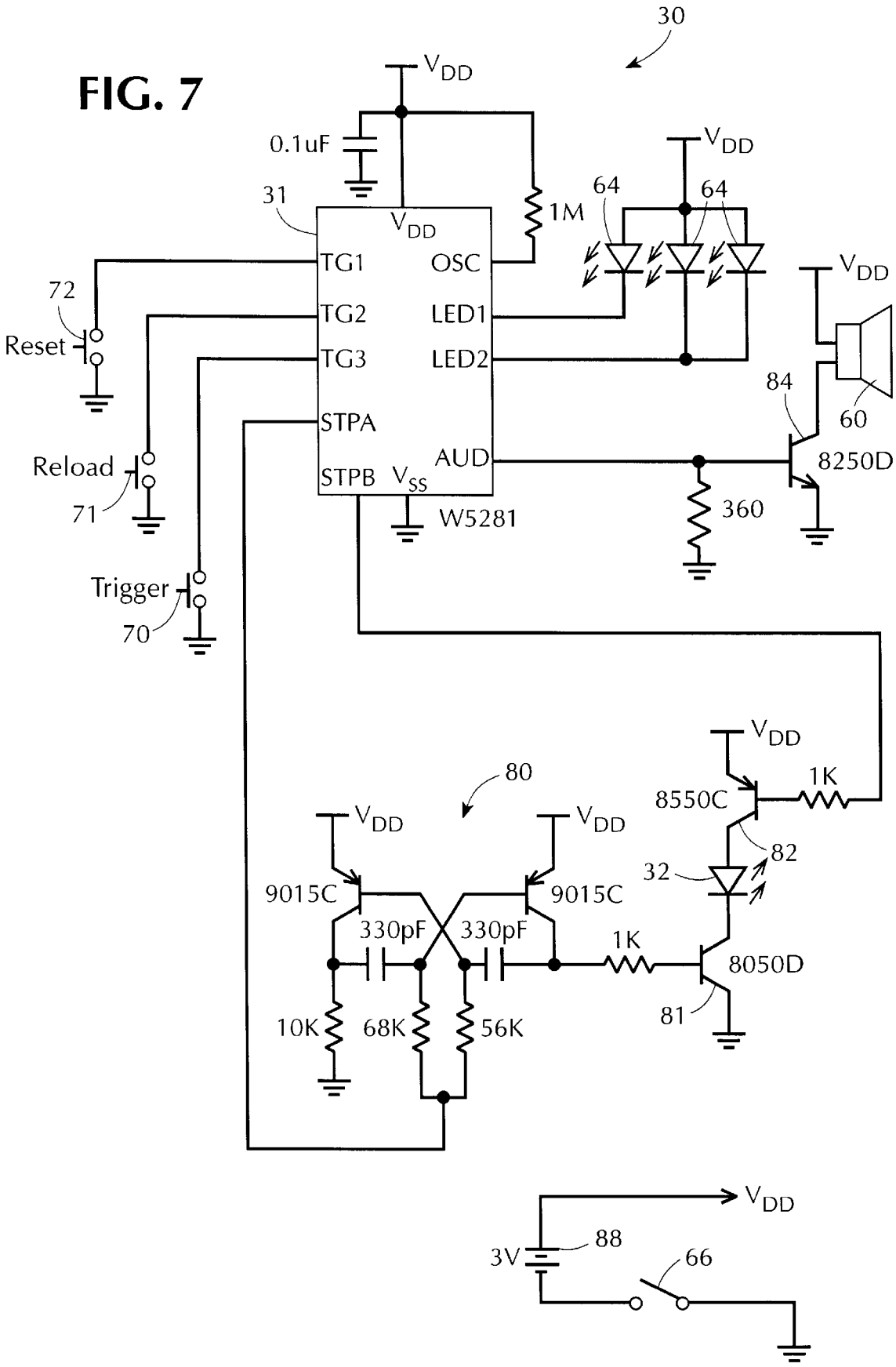
FIG. 7 is a schematic circuit diagram of an electrical circuit carried by the toy light gun depicted in FIG. 1.

The toy light gun 12 includes a housing 13 which carries therein an electrical circuit ("gun circuit") 30 shown in FIG. 7 which includes a controller circuit 31, a light emitter 32 (FIGS. 7 and 13) and an optical system 33 (FIG. 13) which project a beam of light from the toy gun 12 through the light transmitting aperture 35 of the toy light gun (FIGS. 1 and 2) that can be detected by the main and auxiliary vest targets 14 and 18, and by the self-propelled target 16.

Figure 11:
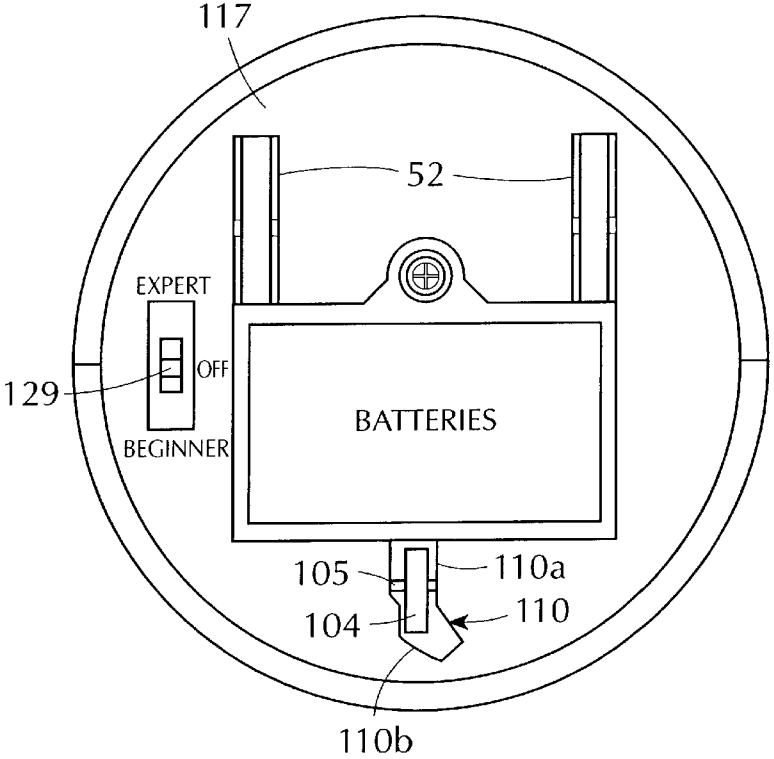
FIG. 11 is a plan view of the bottom of the target depicted in FIG. 5.

As described below, the vest target 14 carries within the housing 15 an electrical circuit ("main vest target circuit) 38 shown in FIG. 8 which includes a controller circuit 40, and the vest target 18 carries within the housing 15*a* an electrical circuit ("auxiliary vest target circuit") 42 shown in FIG. 9 which does not have its own controller circuit but shares the controller circuit 40 (FIG. 7) of the main vest target circuit 38. Therefore, the vest target 14 is referred to as the "main" vest target and the vest target 18 as the "auxiliary" vest target. The self-propelled target 16 has a housing 17 which carries therein an electrical circuit ("self-propelled target circuit 46) shown in FIG. 10 which also has a controller circuit 48. In the preferred embodiment, the self-propelled target 16 includes an electric motor 50 (FIG. 10) and a pair of driven wheels 52 (FIG. 11).

The main vest target 14, the auxiliary vest target 18 and the self-propelled target 16 each include a light receiver 56 (FIGS. 8–10) which detects light projected from the toy gun 12 received by the respective light receiver 56. In the preferred embodiment, the gun light emitter 32 (FIG. 7) is an infrared (IR) light emitting diode (LED) which emits IR light, and the light receivers 56 (FIGS. 8–10) detect IR light. The gun circuit 30 conditions the IR light projected from the toy gun 12, and the main vest target circuit 38, the auxiliary vest target circuit 42 in cooperation with the main vest target circuit 38, and the self-propelled target circuit 46 process IR light received by the respective IR light receiver 56 to determine when light received by a respective IR light receiver 56 is a hit, or a game reset signal, as described below. In the preferred embodiment, the gun circuit 30 amplitude modulates the IR light projected by the gun during short bursts or pulses, and the main vest target circuit 38 and the self-propelled target circuit 46 detect such modulated IR light.

The main vest target 14 and the self-propelled target 16 each have a speaker 60 (FIGS. 8 and 10) which projects sound through a speaker grill 61 in the respective housing 15, 17 (FIGS. 4 and 6), and one or more lamps 62 (FIGS. 8 and 10) controlled by the controller circuit 40 or 48 of the respective electrical circuit 38 and 46 to provide selected audio and/or visual effects associated with a hit, turn-on, game reset, a given number of hits, and game over, as described below. The targets 14, 16 and 18 include light transmitting lenses 63, 64 on the respective housings 15, 15*a*, 17 which transmit light from the respective lamps 62. The toy light gun 12 also has a speaker 60 (FIGS. 2 and 7), a speaker grill 61 (FIGS. 1 and 2) and LEDs 64 (FIGS. 1 and 7) to provide selected audio and/or visual effects associated with firing light pulses and game reset light pulses generated by the toy light gun 12, and toy gun reloading, as described below.

The game is played by a player attempting to "hit" a main or auxiliary vest target 14 or 18, or a self-propelled target 16 with light projected by a light gun 12. Upon detection of light from a toy light gun 12, a main vest target 14, an auxiliary vest target 18 (in cooperation with a main vest target 14) and a self-propelled target 18 will provide audio-visual effects predetermined by the respective circuitry 38 and 46.

The target game provides several features which add to the play value of the game. The toy light gun 12 includes an on-off switch 66 (FIG. 7) activated by a slide button 68 (FIG. 3) on the rear of the toy light gun, and emits a sound for as long as the on-off switch is 66 is on, interrupted by other functions and audio/visual effects. Even if a player turns his or her toy light gun 12 off while approaching another player, when turned on again prior to firing, the toy light gun emits sound to give an opposing player some warning that he or she is about to be shot at. The on-off switch 66 is a two position slide switch which connects and disconnects battery power to the circuit components in the gun circuit 30 as shown in FIG. 7.

The toy light gun 12 includes a trigger switch 70 (FIG. 7), reload switch 71 and a reset switch 72 which control game operation as follows. The toy gun 12 has a spring loaded trigger 73 (FIGS. 1 and 17) and fires a single shot (pulse) of light with each trigger squeeze. The trigger switch 70 is a microswitch having a switch plunger 74 (FIG. 17) positioned within the housing 13 of the toy light gun 12 to be pressed by the pivotally mounted trigger 73. The switch plunger 74 remains depressed as long as the trigger 73 is squeezed, but only a single pulse of light is emitted per trigger squeeze. The gun circuit 30 provides a de-bounce feature such that the circuit 30 responds each time that the trigger switch 70 (FIG. 7) is closed rather than for the length of time that the trigger switch 70 is closed. Because the light emitter 32 in the toy light gun 12 is an LED, which, unlike some prior art "flash" light emitters does not require high energy to "fire", the light emitter 32 will rapidly fire in response to rapid trigger squeezes.

The toy light gun has a reload feature which requires that a player "reload" the light gun after a given number of shots, i.e., light bursts, for example six. Shot count is controlled by the gun circuit 30 (FIG. 7), and reloading is activated by closing the reload switch 71. The reload switch 71 is a microswitch mounted within the housing 13, having its switch plunger 75 (FIG. 18) positioned adjacent a reload button 76 (FIGS. 1 and 18) provided in the side of the gun housing 13. The spring-loaded switch plunger 75 also spring loads the reload switch button 76 so that upon release of the reload switch button 76, it is pushed back by the spring loaded switch plunger 75.

The toy shooting game has a remote reset feature according to which the hits counted in the main vest target circuit 38 and the self-propelled target circuit 46 are reset remotely to start a new game. The main vest target circuit 38 and the self-propelled target circuit 46 count hits or detections of light from a light gun 12, and in response to a given count of hits, end the game. As mentioned, the hit count may be reset remotely to start a new game, and in the preferred embodiment, the hit count in the main vest target circuit 38 or the self-propelled target circuit 46 are reset remotely by the light gun 12. In the preferred embodiment, closing the reset switch 72 (FIG. 7) causes the gun circuit to emit a pulse of light different from pulses of light emitted in response to trigger switch 70 closings. The reset switch 72 is a microswitch identical to the reload microswitch 71 (FIG. 18), mounted within the housing 13 and activated by a reload button (not shown) identical to the reload button 76 mounted on the side of the gun housing 13 opposite to that on which the reload button 76 is mounted.

As mentioned, the optical system of a target (vest targets 14 and 18 in the preferred embodiment) is adjustable (FIGS. 14 and 14A), and the motion of the self-propelled target may be programmed (psuedorandomly in the preferred embodiment). As described above, the auxiliary vest target 18 shares components and interacts with the main vest target 14.

The game is operable under varying light conditions, from darkness, to dim lighting to bright daylight, and for distances exceeding 50 feet. In varying light conditions, performance (e.g., maximum detection distance or hit registration) varies by only about 10%.

How these features and performance are accomplished and how other aspects and features of the game are accomplished are described in more detail below.

Toy Light Gun 12

Referring to FIG. 7, the controller circuit 31 of the gun circuit 30 may be any suitable circuit which can perform the following functions through hardwiring and/or software: cause IR LED light emitter 32 to emit light with different characteristics in response to a trigger switch 70 closing and a reset switch 72 closing; count trigger switch 70 closings and require a reload switch 71 closing to cause the light emitter 32 to emit light after a given number, e.g., six, of consecutive trigger switch 70 closings without a reload switch 71 closing illuminating LEDs 64 and/or producing sounds on speaker 60 in response to given closings of switches 70–72.

In the preferred embodiment, the controller circuit 31 is a W5281 voice synthesizer integrated circuit available from Windbond Electronics Corp. (Republic of China). In addition to programmable processor and control circuitry, the W5281 includes an ADPCM (adaptive differential pulse-code modulation) voice synthesizer. The controller circuit 31 is programmed and connected to operate as described below.

Referring to FIG. 7, the light emitter 32 in the light gun 12 is, as mentioned, an IR LED which is selectively energized by the controller circuit 31 in response to closings of the trigger switch 70 and the reset switch 72. The toy gun 12 emits bursts of IR light from the IR LED 32 through the optical system 33 (FIG. 13) and the aperture 35 (FIGS. 1 and 2) in the front of the light gun. In order for the intended vest or self-propelled target 14, 16 or 18 to determine whether a particular light burst is a shot or a reset, the light output by the IR LED 32 is coded. Any suitable coding, digital and/or analog, may be used, and the vest and self-propelled targets 14 and 16 include suitable decoding circuitry. In the preferred embodiment, the gun controller circuit 31 and associated circuitry described below encode the light bursts by amplitude modulating them (e.g., by chopping) at a preselected frequency, and by providing different length bursts or pulses for IR light projected in response to trigger switch 70 and reset switch 72 closings.

The controller circuit 31 of the gun control circuit 30 (FIG. 7) controls the current supplied to IR LED 32 thorough its STPA and STPB ports, bi-stable multivibrator circuit 80 and transistors 81 and 82 to amplitude modulate the current at the preselected frequency, which in the preferred embodiment is 37.9 KHz. The STPA port is controlled to cause the multivibrator circuit 80 to switch transistor 81 on and off at a 37.9 KHz. rate. The STPB port is controlled to turn transistor 82 on for the preselected pulse widths responsive to a trigger switch 70 closing or a reset switch 72 closing. In response to trigger switch 70 closings and reset switch 72 closings, the controller circuit 31 provides cycles of STPA and STPB port states which cause the IR LED 32 to emit IR light modulated (e.g. chopped) at a 37.9 KHz. rate for a first period of time and for a second period time period, respectively, for example 1.0 ms. and 1.5 ms. However, pulse widths of longer or shorter duration may be used, and other modulation techniques may be used, as will be known to those of skill in the art.

The controller circuit 31 is set by to provide a given number of STPA and STPB cycles in response to trigger switch 70 closings. For example, after six trigger switch 70 closings, the controller circuit 31 does not initiate any further STPA and STPB cycles which would cause IR LED 32 to emit light in response to further trigger switch 70 closings until a reload switch 71 closing. In response to a reload switch 71 closing, the controller circuit 31 resets a count of the closings of the trigger switch 70 and again responds to trigger switch 70 closings to initiate further cycles of the STPA and STPB states. The counting function may be implemented in software and/or hardware in the controller circuit 31.

Figure 1:
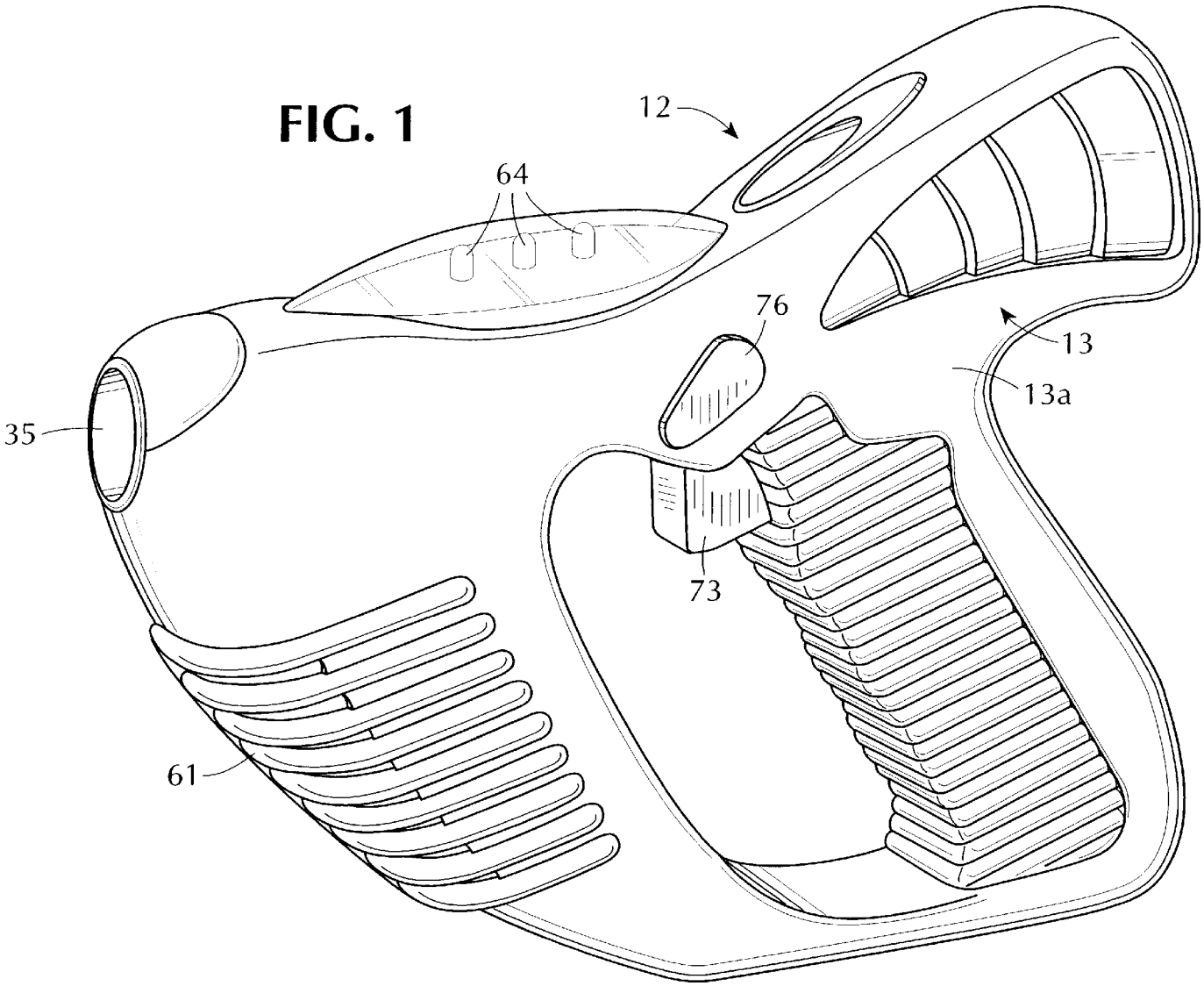
FIG. 1 is a perspective view of the toy light projector or light gun described in application Ser. No. 08/798,895.

The controller circuit 31 of the gun control circuit 30 (FIG. 7) also controls illumination of the LEDs 64. In the preferred embodiment where the controller circuit comprises a W5281 IC, two LED outputs LED1 and LED2 are provided to control illumination of three LEDs 64. Two of the three LEDs 64 are connected in parallel and are illuminated at the same time. However, as shown in FIG. 1, the three LEDs 64 are arranged in a row with the two parallel-connected LEDs being the first and last ones in the row spaced by the third LED, so as to diminish any perception that the two parallel-connected LEDs are being illuminated at the same time.

The controller circuit 31 includes a synthesizer which generates audio signals for different sounds in response to closings of switches 66 and 70–72. In the preferred embodiment where the controller circuit 31 comprises a W5281 IC, the audio signals are output on the AUD output to the base of the speaker drive transistor 84, and the speaker 60 is connected in the collector-emitter circuit of speaker drive transistor 84.

Summarizing, the controller circuit 31 is programmed to provide the following audio/visual responses to closings of the on-off switch 66, the trigger switch 70, the reload switch 71 and the reset switch 72. Closing the on-off switch 66 supplies power from a battery 88 to the controller circuit 31, the LEDs 64, the speaker 60 (speaker drive transistor 84), multivibrator circuit 80 and transistor 82. As long as battery power is applied to the controller circuit 31, it outputs an audio signal to the speaker drive transistor 84 to cause the speaker 60 to sound a beeping sound, which continues except for momentary interruptions for the speaker to perform other functions and sound other sounds in response to the closings of switches 70–72, after which the beeping sound is resumed. In response to a closing of the reload switch 71, the controller circuit 31 (a) resets the count of trigger switch 70 closings and enables the controller circuit 31 to respond to the preprogrammed number of trigger switch 70 closings, and (b) causes an audio signal to be supplied to speaker drive transistor 84 to cause the speaker 60 to sound a gun reloading sound.

In response to a closing of trigger switch 70 (FIG. 7), the controller circuit 31 (a) causes its STPA and STPB outputs to go to logic low levels to sink current in a sequence to supply current at 37.9 Khz. through IR LED 32 for the first time period, and at the same time (b) to supply audio signals to speaker drive transistor 84 to cause speaker 60 to sound a futuristic laser shot sound and (c) alternatingly cause its LED 1 and LED2 outputs to go low and sink current to alternatingly flash the LEDs 64 for a short time period, e.g., one to two seconds, as discussed above. After the preprogrammed number of trigger switch 70 closings has been reached, the controller circuit will not respond to further trigger switch 70 closings until it senses a closing of the reload switch 71. During the first time period, the IR LED 32 emits a burst or pulse of IR light modulated at 37.9 KHz. of width equal to the first time period.

In response to a closing of the reset switch 72 (FIG. 7), the controller circuit 31 (a) causes its STPA and STPB outputs to go to logic low levels to sink current in a sequence to supply current at 37.9 KHz. through IR LED 32 for the second time period, and (b) to supply audio signals to speaker drive transistor 84 to cause speaker 60 to sound a reset firing sound somewhat similar to but easily distinguishable from a light burst firing sound. During the second time period, the IR LED 32 emits a burst or pulse of IR light modulated at 37.9 KHz. of width equal to the second time period.

As discussed below, the main vest target circuit 38 (FIG. 8) in the vest target 14 and the self-propelled target circuit 46 (FIG. 10) in the self-propelled target 16 detect the bursts of 37.9 KHz. modulated IR light and can distinguish between the first and second time periods to thereby determine whether the detected IR light corresponded to a trigger switch 70 closing or a reset switch 72 closing.

The invention provides a simple and inexpensive scheme for eliminating response to stray and spurious IR light and for coding the IR light for shots and reset. Simply modulating the IR light at a preselected frequency for pulses of different widths, as described above, accomplishes this.

Main Vest Target 16

Figure 8:
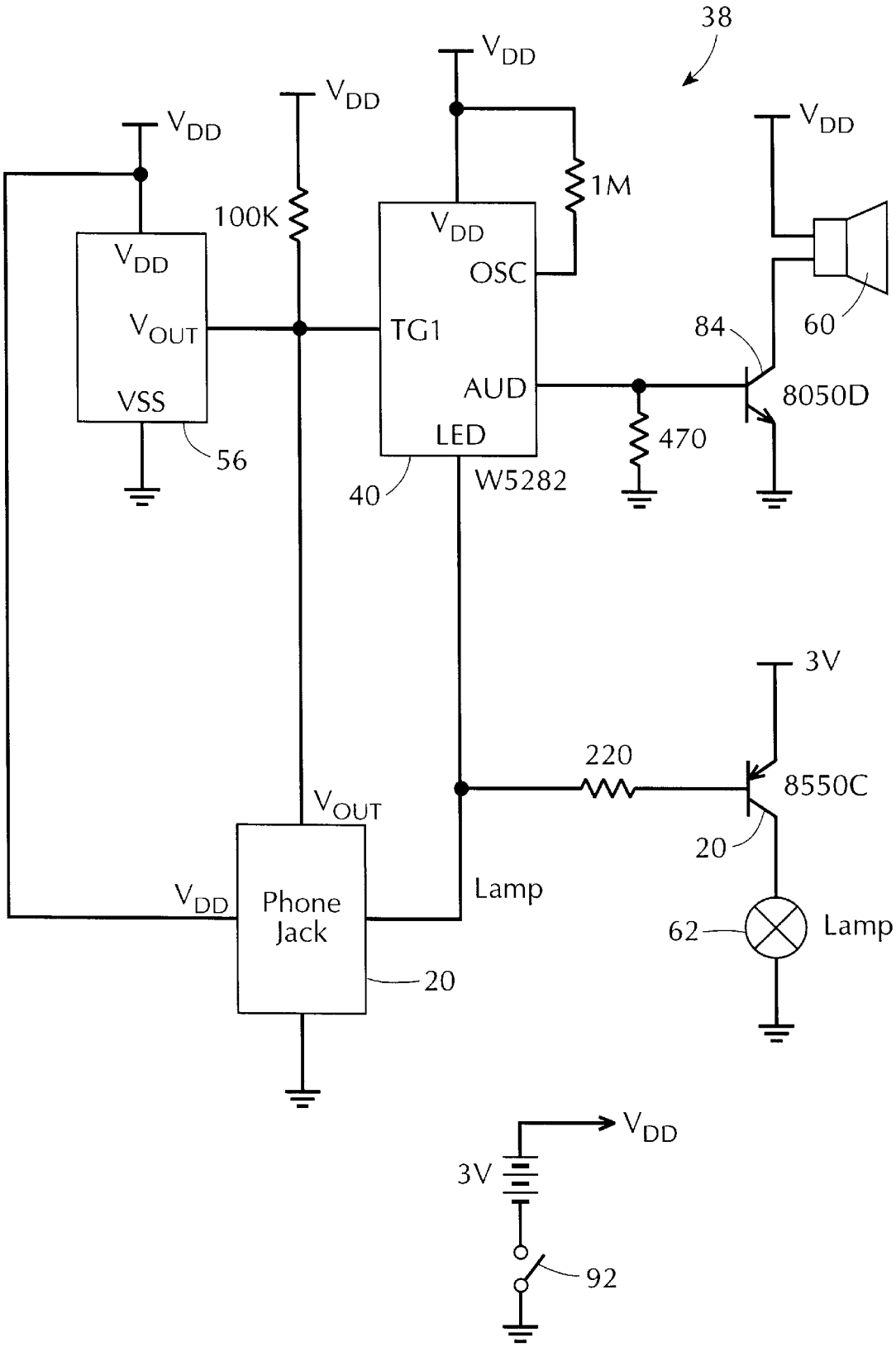
FIG. 8 is a schematic circuit diagram of an electrical circuit carried by the player-worn target depicted in FIG. 4.
Figure 9:
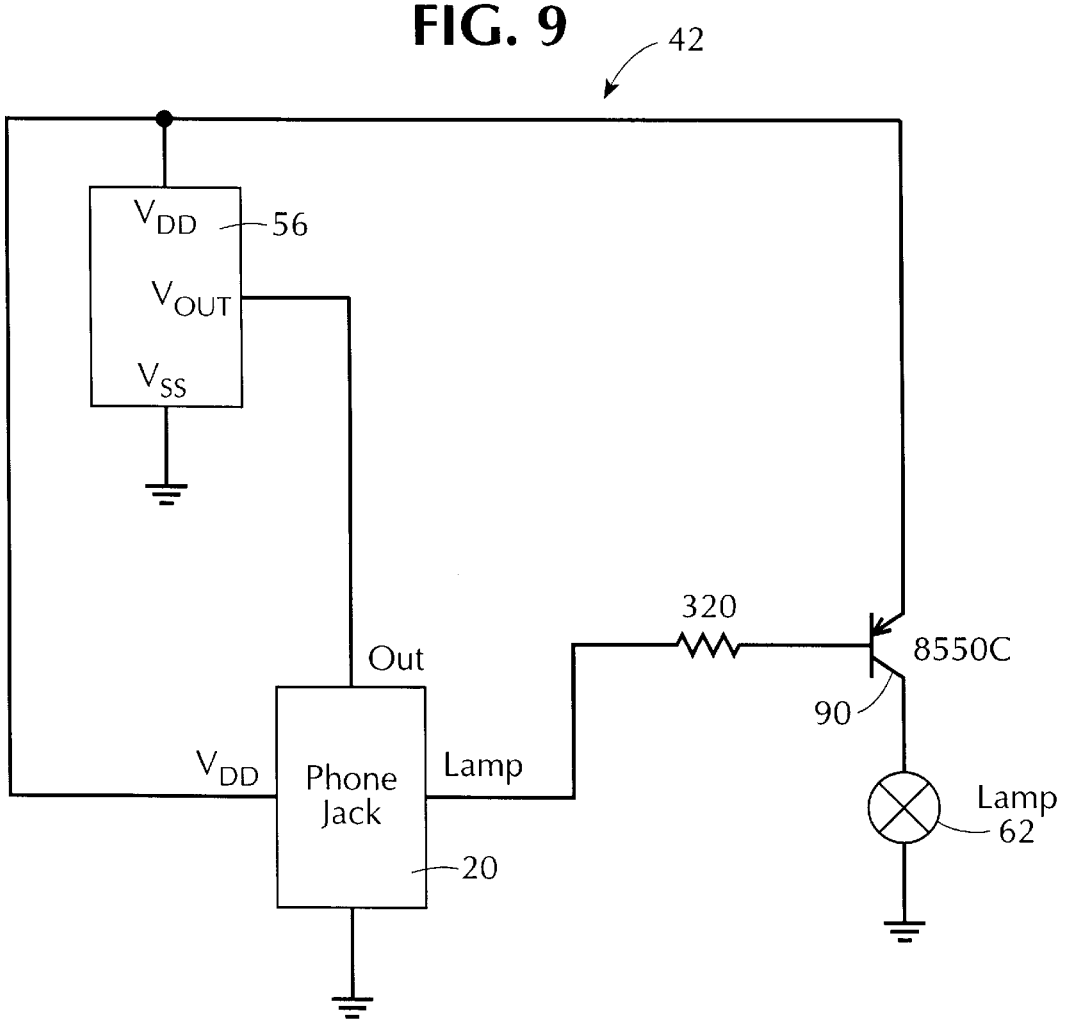
FIG. 9 is a schematic circuit diagram of an electrical circuit carried by the player-worn target depicted in FIG. 5.

Referring to FIG. 8, the main vest target circuit 38 includes the IR receiver 56, the controller circuit 40, the speaker 60, a speaker drive transistor 84, a miniature lamp 62, a lamp drive transistor 90 for a miniature lamp 62, an on-off switch 92 (FIGS. 4 and 8) and a phone jack 20 (FIGS. 4 and 8). The IR light receiver 56 provides an output related to the IR light it detects, for example the IR light receiver 56 provides a given logic level on its $V_{out}$ output when it detects IR light with given characteristics. In the preferred embodiment, the IR light receiver 56 is a 12043 Series infrared receiver available from Kodenshi Corp. (Tokyo. Japan). The 12043 Series infrared receiver detects infrared light modulated at a given $f_0$ frequency of 37.9 KHz., and in response provides a low logic level on the $V_{out}$ output.

The controller circuit 40 (FIG. 8) is coupled to the $V_{out}$ output of the IR light receiver 56, and determines whether the IR light detected by the IR light receiver 56 has given characteristics. For detected IR light that has the given characteristics, the controller circuit 40 provides audio signals to speaker drive transistor 84 and LED drive signals on its LED output to flash the lamp 62, for a short period of time, e.g., one to two seconds. In the preferred embodiment, the controller circuit 40 is a model W5282 integrated circuit available from Windbond Electronics Corp.

In the preferred embodiment, the IR light receiver 36 (FIG. 8) provides a low output on its $V_{out}$ output as long as it detects IR light modulated at 37.9 KHz. The controller circuit 40 at its TG1 port receives the output from the IR light receiver 56 and determines the length of the IR light pulse or burst detected by the IR light receiver 56. For light bursts of the first and second pulse widths, indicative of a trigger switch 70 closing and a reset switch 72 closing in the light gun 12, the controller circuit 40 provides different outputs to the speaker drive transistor 84, and only provides drive to the lamp drive transistor 90 in response to detected light burst of the first pulse width (trigger switch closings). Also, detected first pulse widths are counted by the controller circuit 40 as hits, and after a first and second number of hits, the controller circuit 40 provides different outputs to the speaker drive transistor 84 and terminates the game after counting the second number of hits. The on-off switch 92 supplies battery power $V_{DD}$ from a battery 94 to the circuit components as shown in FIG. 8.

The controller circuit 40 (FIG. 8) is programmed to provide the following audio/visual responses to closings of the on-off switch 92 and detection of the first and second pulse widths output by the IR light receiver 56. Closing the on-off switch 92 causes the controller circuit 40 to reset the count of hits therein and to provide audio signals to speaker drive transistor 84 to sound a reset e.g., a single, long siren sound, and to provide a sequence of low logic levels on its LED output to flash the lamp 62. In response to a low logic level of the first pulse width on the $V_{out}$ output of the IR light receiver 56, the controller circuit 40 counts a hit and provides audio signals to the speaker drive transistor 84 to cause the speaker 60 to sound a hit sound, e.g., crash sound, and to provide a sequence of low logic levels on the LED output to flash the lamp 62. The counting function may be implemented in the controller circuit 40 by software and/or hardware.

Upon counting the first given number of hits, the controller circuit 40 also supplies audio signals to the speaker drive transistor 84 to cause the speaker 60 to sound a game almost over sound e.g., short, repeating siren sounds. Upon counting the second given number of hits, the controller circuit 40 also supplies audio signals to the speaker drive transistor 84 to cause the speaker 60 to sound a game over sound, e.g., a bomb sound. The first given number may be five hits and the second given number to end a game may be six hits. After counting the second given number of hits, the controller circuit 40 does not respond to further hits until either the on-off switch 92 is opened and closed, or IR light of a second pulse width is received by the IR light receiver 56. Upon detecting a low at the TG1 input for the second pulse width, the controller circuit 40 provides the outputs described above for a closing of the on-off switch 92 to reset the hit counter and restart the game.

The main vest target 14 and the auxiliary vest target 18 each have a phone jack 20 (FIGS. 4 and 5) for electrically connecting an auxiliary target 18 to a main vest target 14. The phone jack 20 (FIG. 8) in the main vest target 14 has connected thereto the LED output and the TG1 input of the controller circuit 40 and the $V_{DD}$ battery voltage. An auxiliary target 18 by virtue of the connections of the phone jack 20 to the controller circuit 40 and the battery 94, shares the controller circuit 40, the speaker 60, the battery 94 and the on-off switch 92 of the main vest target 14 to which it is connected, as described below.

The controller circuit 40 may output audio signals for speech in addition to or in place of the sounds described above, and many combinations of sound, speech and light for both content and sequence may be programmed. Also, more than one lamp 62 may be driven by transistor 90, and more than one lamp circuit may be provided.

Auxiliary Vest Target 18

The auxiliary vest target circuit 42 (FIG. 9) includes an IR light receiver 56 a lamp driver transistor 90, a lamp 62 and a phone jack 20. The IR light receiver 56 is identical to that in the main vest target circuit 38, and has its output $V_{out}$ connected to the phone jack 20. The controller circuit 40 (FIG. 8) in the main vest target circuit 38 receives the output of the IR light receiver 56 in the auxiliary vest target circuit 42 and responds to the pulses output by the IR light receiver as described above. Thus, the controller circuit 40 in the main vest target circuit 38 counts hit IR pulses and responds to reset IR pulses from the IR light receivers 56 of both the main vest target circuit 38 and the auxiliary vest target circuit 42. The controller circuit 40 of the main vest target circuit 38 supplies audio signals to the speaker drive transistor 84 in the main vest target circuit 38, and supplies LED output signals to the lamp drive transistors 90 in the main vest target circuit 38 and in the auxiliary vest target circuit 42 via the phone jacks 98 and wires in set 19 (FIG. 5) connecting the phone jacks, in response to hit and reset pulses from the IR receivers 56 of both the main and auxiliary vest targets. The on-off switch 92 in the main vest target circuit 38 controls the battery power supplied to the auxiliary vest target circuit 42 via phone jacks 20 and wires in set 19.

Self-propelled Target

The self-propelled target circuit 46 (FIG. 10) includes a controller circuit 48, an IR light receiver 56, a speaker drive transistor 84, a speaker 60 and three lamp drive transistors 90 which drive three lamp 62 of different color. These components operate as described above for the controller circuit 40 of the main vest target circuit 38 with respect to audio/visual and game termination and reset functions, except that three lamps 62 are illuminated from three outputs (STPA. STPB and STPC) of the controller circuit 48. In the preferred embodiment, the controller circuit 48 of the self-propelled target circuit 46 is a W5282 integrated circuit available from Windbond Electronics Corp. The controller circuit 48 is programmed differently from the controller circuit 40 of the main vest target circuit 38 in order to illuminate three lamps 62 instead of one, and also to provide for driving the motor 50 in the self-propelled target 16.

Figure 12:
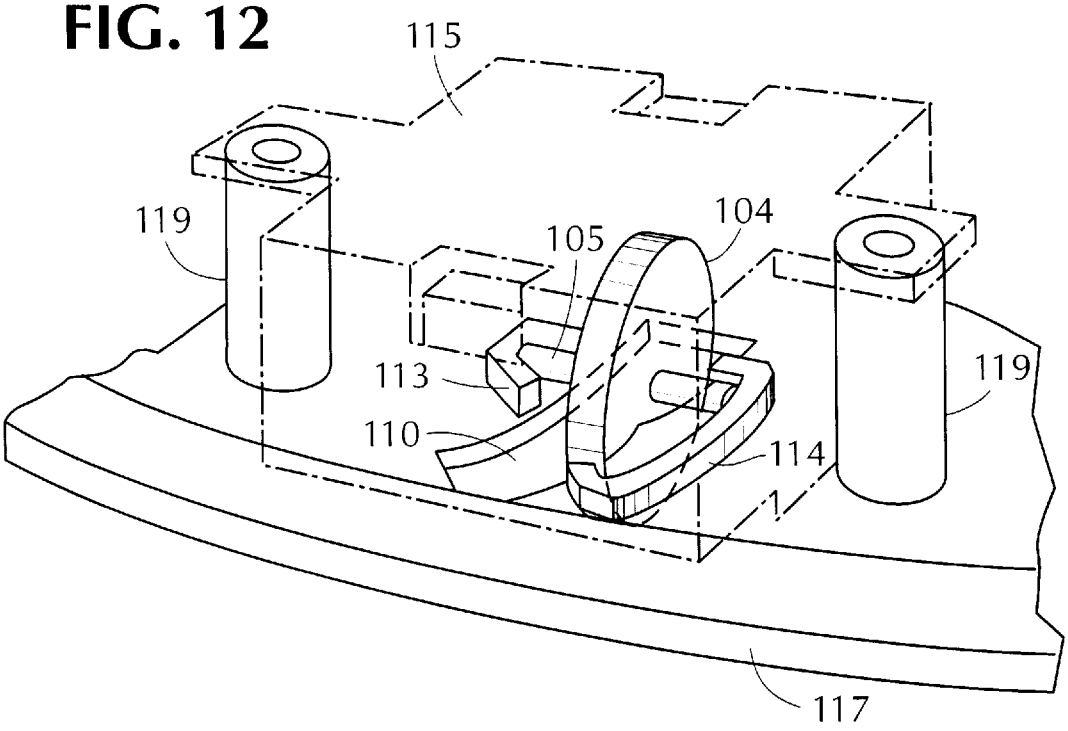
FIG. 12 is a perspective view of a portion of the bottom of the self-propelled target depicted in FIG. 6 with the housing removed, showing one of the wheels on which the self-propelled target rides and the supporting structure therefor.
Figure 12A:
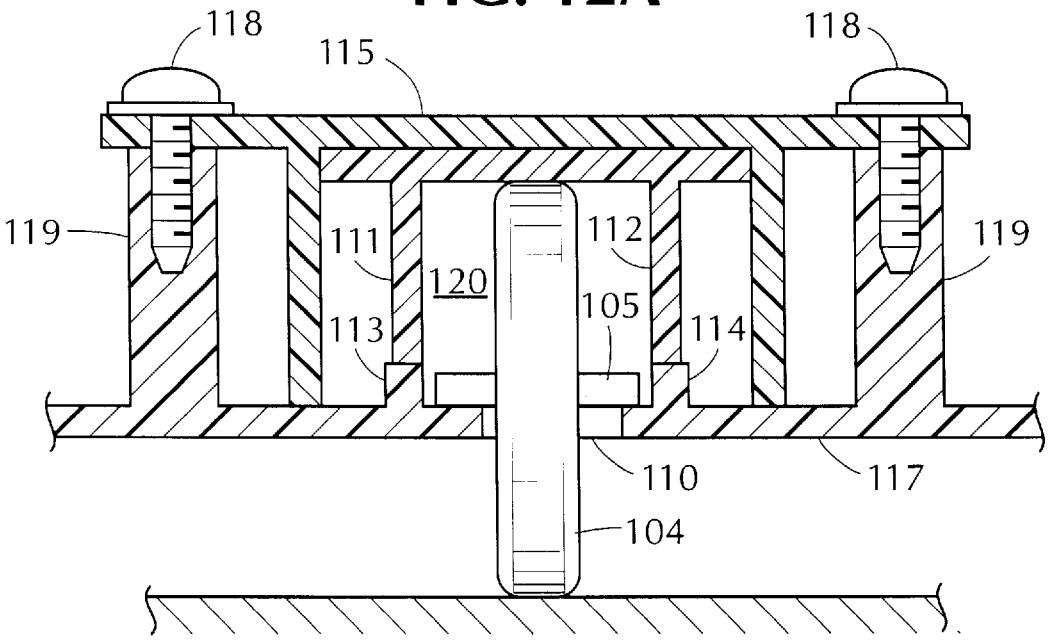
FIG. 12A is a section view through the bottom of the self-propelled target depicted in FIG. 6 showing the portion depicted in FIG. 12.

The driven wheels 52 (FIG. 11) are mounted on a common shaft or axle (not shown) driven by the shaft (not shown) of the motor 50 (FIG. 10) and gearing (not shown). The wheels 52 are driven by the motor 50 in both clockwise (forward) and counterclockwise (reverse) directions with reference to FIG. 11. A third, undriven wheel 104 (FIGS. 11, 12 and 12A) is mounted for free rotation forward of the driven wheels 52. The axle 105 of the wheel 104 is suspended as shown in FIGS. 12 and 12A for pivotal movement within a slot 110 in the bottom 117 of the target housing 17. The axle 105 is retained in a track 120 defined by upper wall sections 111 and 112 (FIG. 12) and lower wall sections 113 and 114 within the target 16). Wall sections 111 and 113 are aligned and have generally the same configuration, and wall sections 112 and 114 are aligned and have generally the same configuration. The upper wall sections 111 and 112 depend from a housing 115 connected to the bottom 117 of the target 16 by screws 118 received in posts 119 connected to the bottom 117. The lower wall sections are integral with the bottom 117 and project upwardly, meeting the upper wall sections 111 and 112 to define a non-linear retaining space or track 120 for the opposite ends of the axle 105. The slot 110 (FIG. 11) has a section 110*a* perpendicular to the axle of wheels 52 and a section 110*b* forwardly thereof at a non-parallel angle thereto, which as shown is an acute angle. The track 120 (FIG. 10) prevents one end of the axle 105 from translating while allowing the other end to swing, thereby providing a pivotal movement of the non-driven wheel 104 in the slot 110 which acts to change the direction of movement of the self-propelled target 16 as driven by wheels 52 in both forward and reverse directions of movement of the self-propelled target.

Figure 10A:
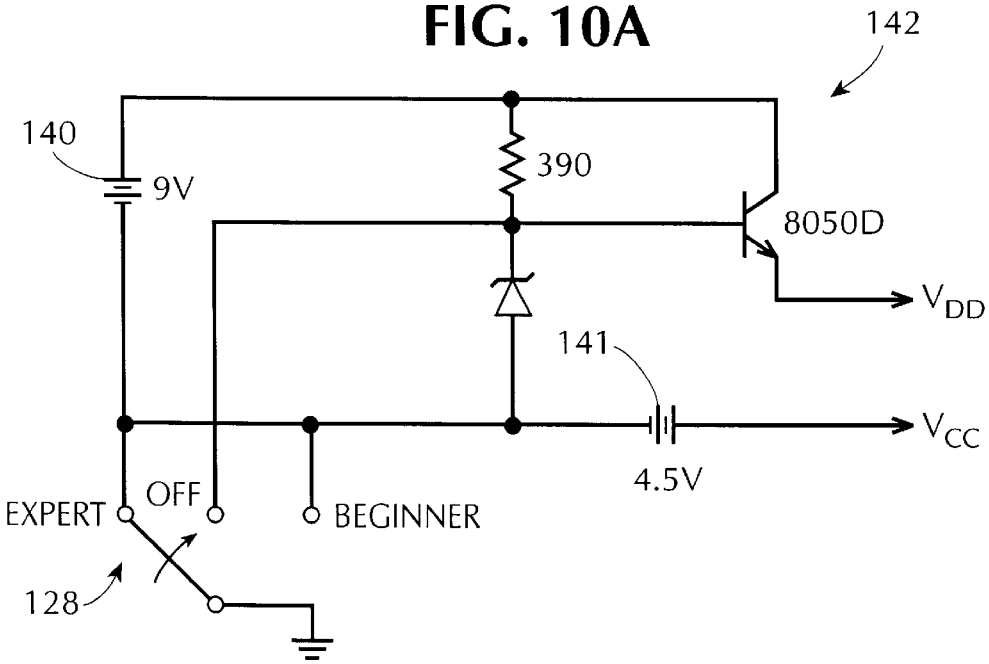
FIG. 10A is a schematic circuit diagram of the switch and power supply circuit for the circuit of FIG. 10.
Figure 10:
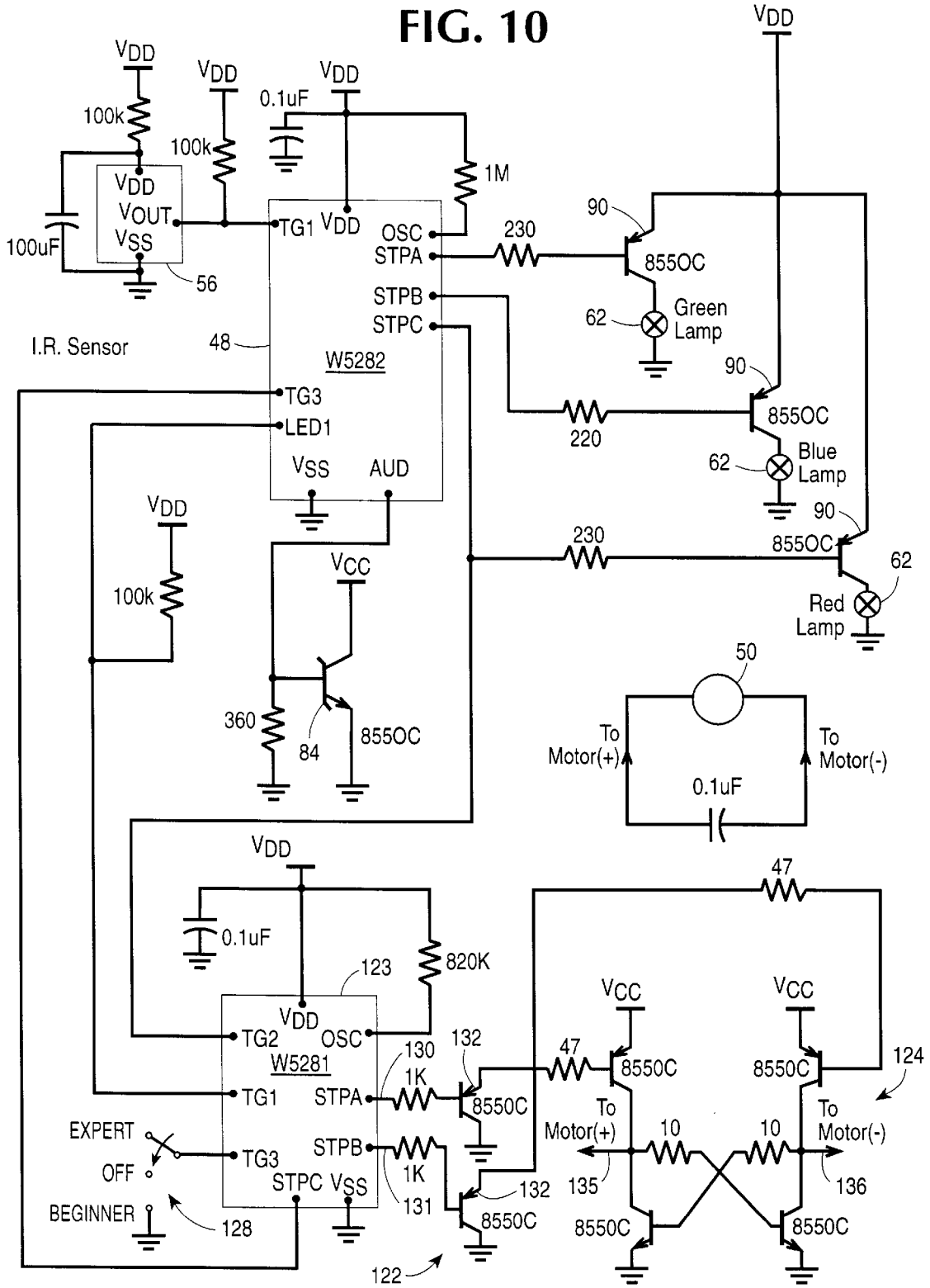
FIG. 10 is a schematic circuit diagram of an electrical circuit carried by the self-propelled target depicted in FIG. 6.

Referring to FIG. 10, the direction of rotation of the motor 50 and the sequence of changes in direction thereof are controlled by a motor control circuit 122 which includes a controller circuit 123 and a drive circuit 124. The controller circuit 123 is programmed by software and/or hardwiring to provide the motor direction sequence and the duration of the sequence. In the preferred embodiment, the controller circuit 123 is a model W5281 integrated circuit available from Windbond Electronics Corp. The controller circuit 123 is programmed to provide a pseudorandom sequence of outputs on outputs STPA and STPB. The controller circuit may be further programmed to make the sequence responsive to the inputs on ports TG1 and TG2. The TG1 port of controller circuit 123 is connected to the LED 1 output of controller circuit 48; the TG2 port of the controller circuit 123 is connected to the STPC port of the controller circuit 48. The TG3 port of controller circuit 122 is connected to a two pole, three position switch 128 (part of which is shown in FIG. 10A), and the input on TG3 determines the length of the sequence. e.g., 35 or 58 seconds (designated EXPERT and BEGINNER, respectively, in FIG. 11 alongside the switch lever 129 of the switch 128). Switch 128 also functions as an on-off switch. Referring to FIGS. 10 and 10A, in one position of the switch 128, it connects the TG3 port of the controller circuit 122 to ground; in a second position it floats the TG3 input; and in the third position it floats the TG3 input and also opens the circuits of batteries 140 and 141 by disconnecting them from ground. Switching the switch 128 to the first or second position (FIG. 10A) closes the battery circuits and at the same time selects a sequence length.

The drive circuit 124 (FIG. 10) is a bistable multivibrator circuit having inputs 130, 131 connected to the STPA and STPB ports of the controller circuit 123 through respective transistors 132, and complementary outputs 135, 136 connected to the motor 50. Low levels on the STPA and STPB ports of the controller circuit 123 set and reset the multivibrator circuit 124 and toggle the outputs 135 and 136 at varied intervals of 0.5 sec., 1.0 sec. and 1.5 sec. to cause the motor 50 to reverse direction. Other time intervals for changing direction may be used, and other techniques for changing motor direction may be used, as will be known to those of skill in the art.

The self-propelled target circuit 46 (FIG. 10) has two batteries (FIG. 10A). battery 140 and battery 141, and a voltage regulator 142 coupled to battery 140. Battery 141 provides voltage $V_{CC}$ connected to the drive circuit 120 via switch 128 and battery 140 provides voltage to the voltage regulator 142 which provides the voltage $V_{DD}$ to all other circuit components in FIG. 10 of the self-propelled target circuit 46.

For counting hits, and responding thereto and to reset pulses, the self-propelled target circuit 46 (FIG. 10) operates as described for the main vest target circuit 38, except that three lamps 62 of different color are illuminated in a given sequence. The self-propelled target 16 has a clear lens 64 (FIG. 6) to allow transmission therethrough of the different colors. The lamps 62 are positioned centrally in the housing 17 of the self-propelled target 16 aligned with the lens 64 and another identical lens (not shown) in the housing 17 opposite lens 64, so that light is projected from opposite side of the target 16 when the lamps 62 are energized. Whenever the switch 128 is in the first or second position (the switch lever 129 shown in FIG. 11 moved to the beginner or expert position), the self-propelled target 16 is self-propelled and moves in a path determined by the sequence of motor reversals controlled by self-propelled target circuit 46, and the configuration of the surface it rides on and obstacles that the self-propelled target encounters to which the third wheel 104 (FIG. 11) reacts. The self-propelled target 16 terminates a game as described for the main vest target 14 (i.e., after a given number of hits, e.g., four), or after the expiration of the selected motor reversal sequence length.

The self-propelled target 16 adds three levels of play value to the game. With a self-propelled target 16, the game may be played by one player. With the pseudorandom motor reversal sequence of the self-propelled target 16 and surface terrain and obstacles, the motion of the self-propelled target is essentially unpredictable during a game. And the self-propelled target 16 provides a time element to the game in addition to the hit count element provided by the vest targets.

Optics

Figure 13:
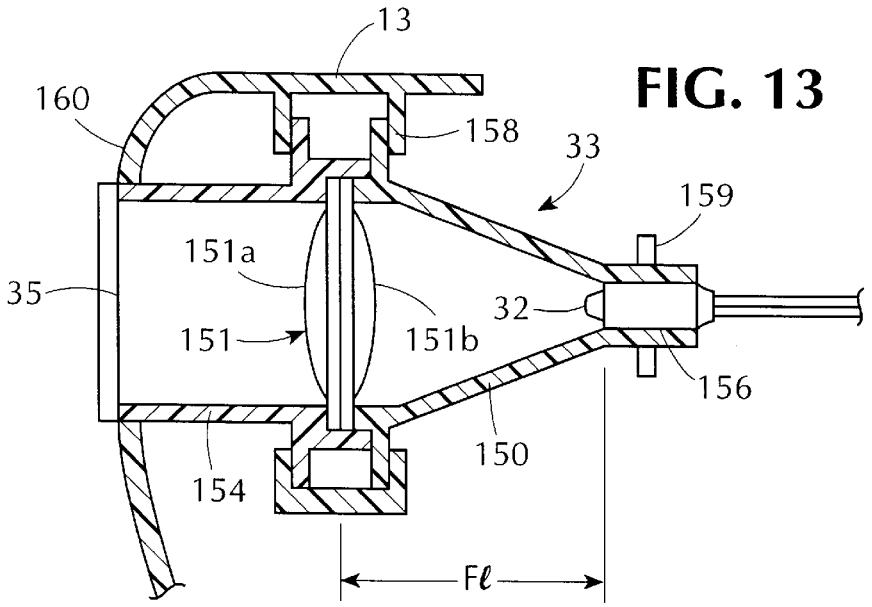
FIG. 13 is a schematic diagram of the optical system of the toy light gun depicted in FIG. 1.

Referring to FIG. 13, the optical system 33 of the toy light gun 12 includes a conical section 150, a lens 151 comprised of a pair of convex lenses 151*a* and 151*b* placed flat side to flat side, a tubular section 154 and the aperture 35. The IR LED 32 is positioned in a tubular opening 156 at the apex of the conical section 150, and the lens 151 is positioned at the maximum diameter end of the conical section 150 where the conical section 150 meets the tubular section 154. The focal length "f1" of the lens 151 in the preferred embodiment is 19.0 mm. The interior surfaces of the conical section 150 and the tubular section 154 are coated with a black, non-reflective paint. The optical system 33 projects IR light from the IR LED 42 through the aperture 35 and out of the toy light gun 12 in a narrow beam. The optical system 33 is held in the gun housing 13 (partially shown in FIG. 13) by annular flanges 157, 158, 159 and 160 attached to the gun housing 13.

Figure 14:
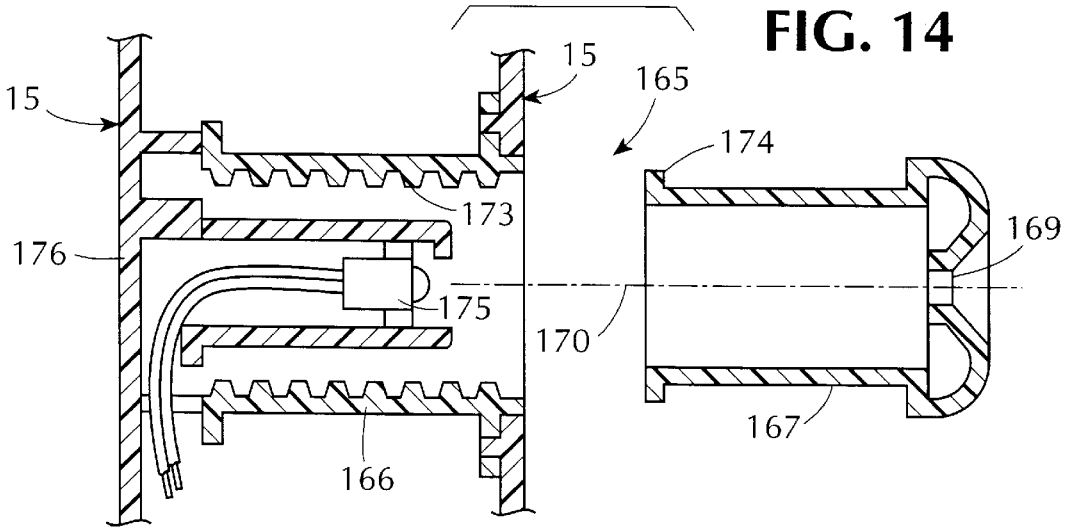
FIG. 14 is a partially exploded section view of the optical system of the player-worn target depicted in FIG. 4.

Referring to FIG. 14, the optical system 165 in the main and auxiliary target vests 14 and 18 comprises telescoping tubular sections 166 and 167. Tubular section 167 has an aperture 169 through which IR light from a toy light gun 12 is admitted into the optical system 165. The aperture 169 is aligned with the optical axis 170 of the optical system 165. The tubular section 166 is internally threaded (173) and the tubular section 167 has an annular tab 174 which functions as an external thread so that the tubular section 167 may be advanced out of and retracted into the tubular section 166 with a simple manually-applied rotating action, to change the length of the optical path from the aperture 169 to the IR detector element 175. The IR detector element 175 of the IR light receiver 56 is connected to the rear 176 of the vest targets housings 15, 15*a*, aligned with the optical axis 170, positioned in the end of the tubular section 166 opposite to the end into which the tubular section 167 projects. The interior surfaces of the tubular sections 166 and 167 are coated with a black, non-reflective paint.

Figure 15:
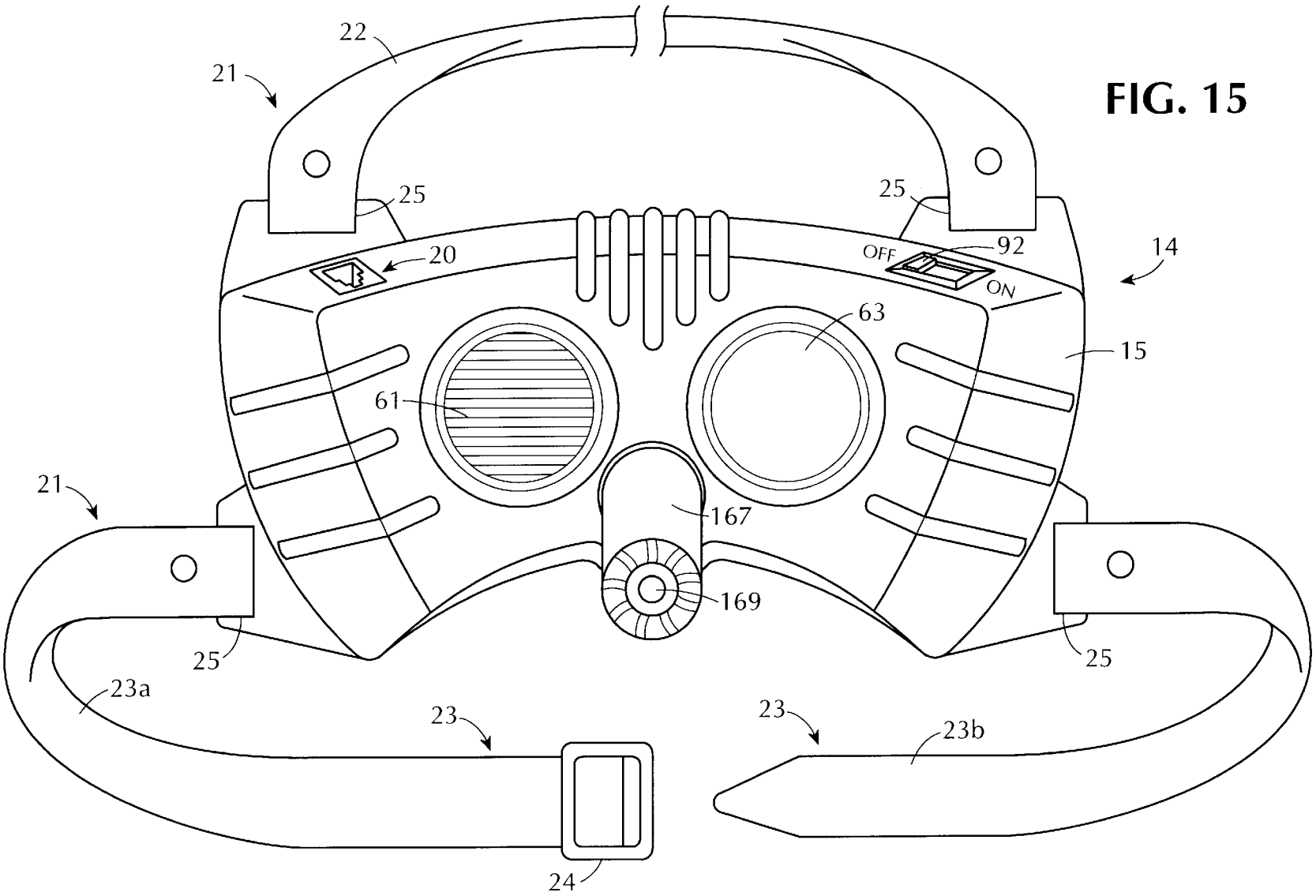
FIG. 15 is a perspective view of the player-worn target depicted in FIG. 4 but with the optical system thereof for admitting light into the target in a different configuration from that in FIG. 4.

Retracting the tubular section 167 into the tubular section 166 positions the IR detector element 175 closer to the aperture 169 (shortens the optical path), which enlarges the angle at which entering beams of IR light may impinge upon the IR detector element 175. This makes it easier for a player to hit the detector element with a beam of light from a toy light gun 12. FIG. 4 shows the tubular section 167 fully retracted. Conversely, advancing the tubular section 167 out of the tubular section 166 positions the IR detector element 175 farther from the aperture 169 (lengthening the optical path), which reduces the angle at which entering beams of IR light may impinge upon the IR detector element 175. This makes it harder for a player to hit the detector element with a beam of light from a toy light gun 12. FIG. 15 shows the tubular section 167 fully advanced. Other arrangements may be used to change the length of the optical path and to enhance and/or retract IR light entering the optical system 165 for the main vest target 14

Figure 14A:
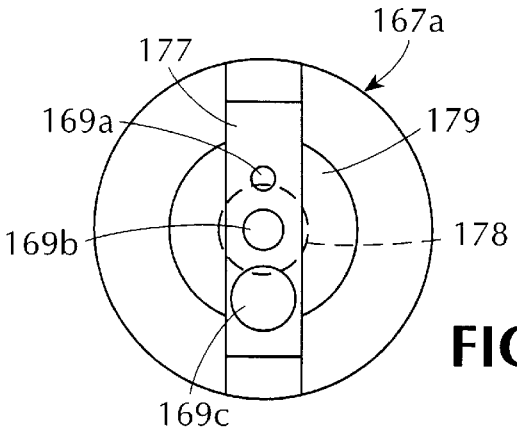
FIG. 14*a* is an elevation view of an alternate embodiment of the aperture of optical system of the player-worn target.

For example, referring to FIG. 14A, the size of the aperture 169 may be adjusted in lieu of or in addition to adjusting the length of the optical path. As shown in FIG. 14A, a slide 177 with different diameter apertures 169*a*, 169*b*, 169*c* has been added to the end 179 of tubular section 167*a* which has an opening 178 of diameter equal to or larger than that of the largest aperture 169*c*. Detents (not shown) are provided to engage the slide 177 in positions aligning an aperture 169*a*, 169*b*, 169*c* with the optical axis 170. Shutter mechanisms and other known mechanisms may be used to change the size of the aperture 169 which admits light into the optical system 165.

Figure 16:
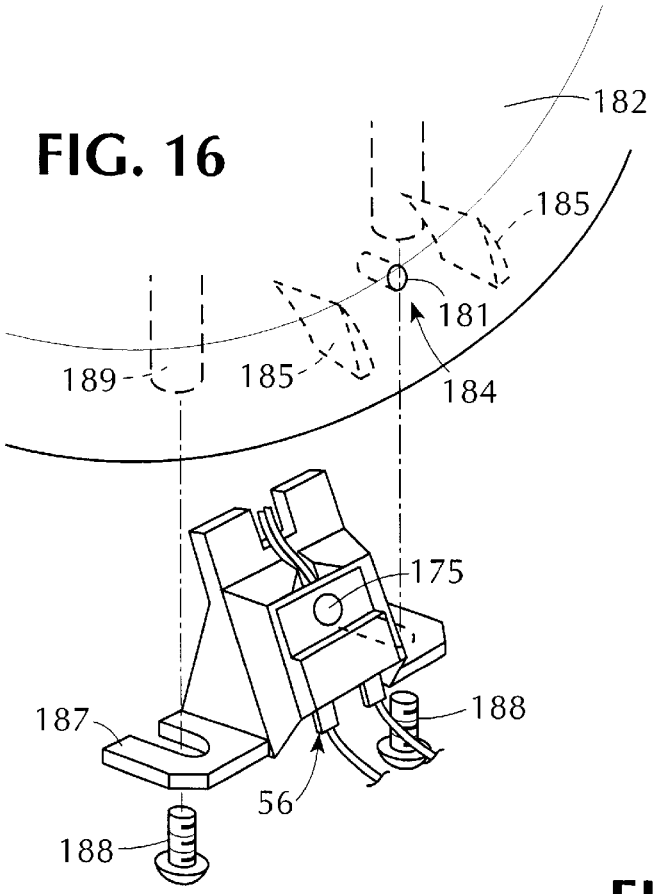
FIG. 16 is an exploded perspective view of the optical section of the self-propelled target depicted in FIG. 6.

Referring to FIGS. 6 and 16, the optical system 180 for the self-propelled target 16 comprises an aperture 181 in the top 182 of the target housing 17 and a fixed length light passage referenced generally by 184 formed by baffles 185 depending from the top 182. The IR light receiver 56 is attached to a bracket 187 with the IR detector element 175 between the baffles 185 facing the aperture 181 The bracket 187 is connected to the top 182 by screws 188 threaded into posts 189 depending from the top 182. The aperture 181 is relatively small so that "hitting" the self-propelled target will not be too easy.

Either the optical systems of the gun and a target, or possibly the optical system of one of them, or the coding of the light pulses, or both, are responsible for the line-of-sight operation of the preferred embodiment of the of the toy shooting game described herein.

Gun Switches

Figure 17:
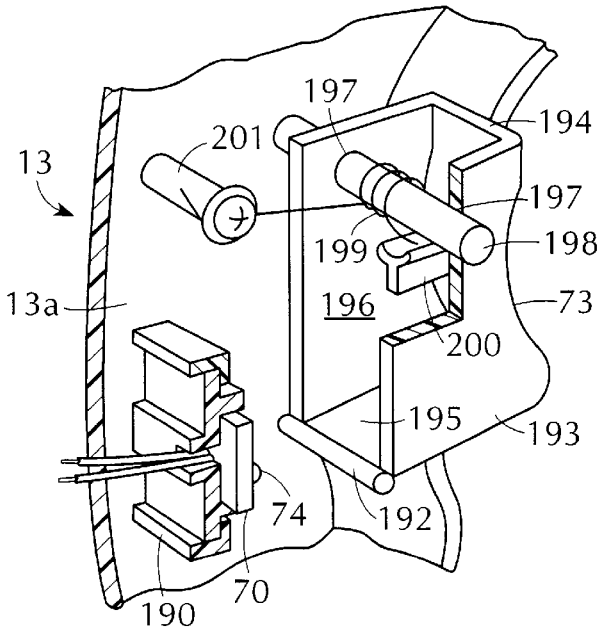
FIG. 17 is a perspective view of the trigger mechanism of the toy light gun depicted in FIG. 1 with part of the trigger shown in section.

Referring to FIG. 17, the trigger switch 70 is mounted to a bracket 190 extending from one side 13*a* of the gun housing 13, and has a switch plunger 74 activated by a rib 192 on the pivotally mounted trigger 73. The trigger 73 has parallel side walls 193, a front wall 194 and a bottom wall 195 which define a space 196 therebetween. The trigger 73 has aligned holes 197 in the sidewalls 193 through which passes a shaft 198 fixed to the side 13*a* of the gun housing 13. The holes 197 are sized to permit the trigger 73 to pivot on the shaft 198. A hair spring 199 is wound around the shaft 198, with one end bearing against a retainer 200 in the front wall 194 and the other anchored on a post 201 fixed to the side 13*a* of the gun housing 13. The trigger 73 is biased away from the switch plunger 74 by the spring 199. Pivoting the trigger 73 against the action of the spring 199 causes the rib 192 to contact and depress the switch plunger 74.

Figure 18:
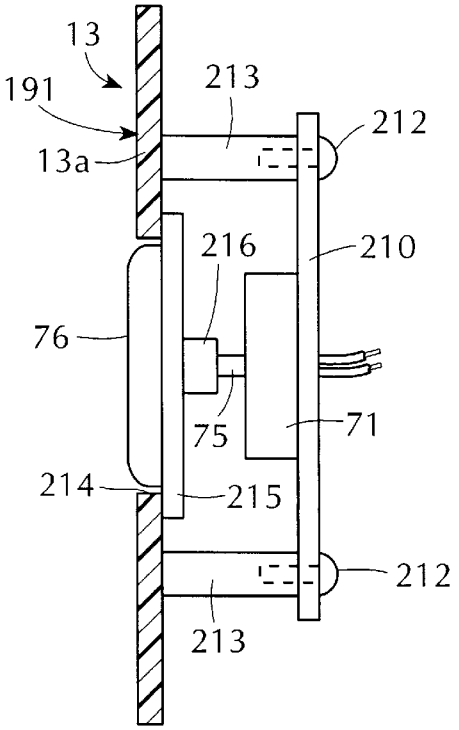
FIG. 18 is a section view of one of the switch mechanisms mounted to the side of the toy light gun of FIG. 1.

Referring to FIG. 18, the reload switch 71 is mounted to a printed circuit board 210 mounted to the side 13*a* of the gun housing 13 by screws 212 threaded to posts 213 connected to the gun housing side 13*a*. The reload button 76 is mounted in a hole 214 in the side 13*a* of the gun housing 13. The reload button 76 is larger than the hole 214 and has a rib 215 about its periphery which retains the reload button 76 in the hole 214. The reload button 76 has a projecting post 216 contacting the switch plunger 75 to prevent the reload button 71 from falling into the gun. Pressing the reload button 71 depresses the switch plunger 75 which is spring loaded and thereby spring loads the reload button 71.

Targets Providing a Feelable Output

Figure 19:
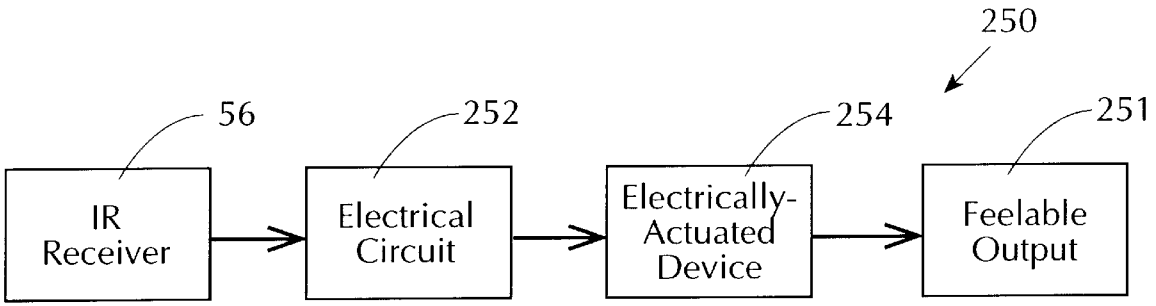
FIG. 19 is a block diagram of a target incorporating the invention disclosed herein which includes an electrically actuated device that provides the feelable output.

Referring to FIG. 19, a target 250 which provides a feelable output 251 includes an IR receiver 56, an electrical circuit 252 coupled to the IR receiver 56 which provides one or more outputs in response to IR energy detected by the IR receiver 56, and an electrically activated device 254 coupled to the electrical circuit 252. The IR receiver 56 may be identical to the IR receiver 56 in FIG. 8, and the electrical circuit 252 may include a controller 40*a* similar to the controller 40 in FIG. 8. The electrically activated device 254 may include a motor or solenoid, as described below, and a device responsive thereto which provides the physical output 251.

Figure 20:
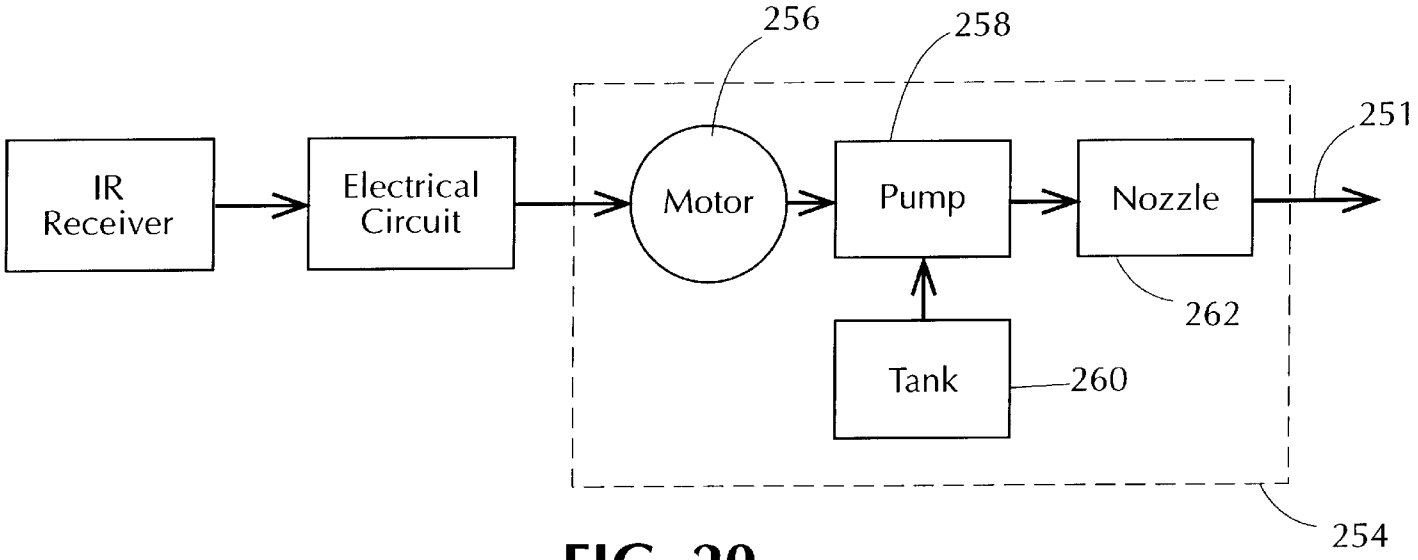
FIG. 20 is a block diagram of a target incorporating the invention in which the electrically actuated device shown in FIG. 19 is a motor which drives a pump to eject water from the target.

Referring to FIG. 20, the electrically activated device 254 may include an electrical motor 256 coupled and responsive to the electrical circuit 252. The motor 256 drives a pump 258 which ejects water 251*a* from a tank 260 through one or nozzles 262. The motor 256, pump 258, tank 260 and one or more nozzles 262 may be conventional, and will be known to those of skill in the art.

Figure 21:
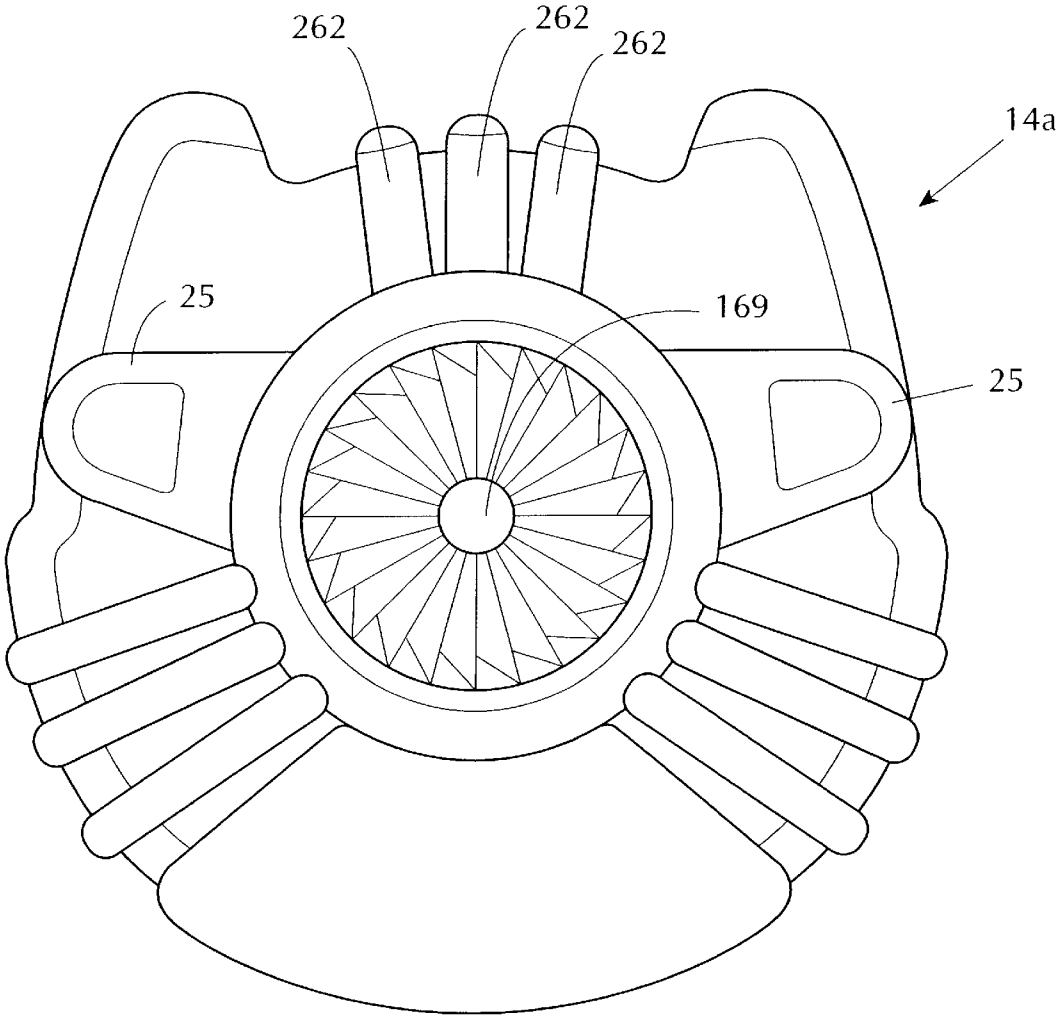
FIG. 21 is a front view of a vest target similar to the one shown in FIG. 4, which includes the motor, pump and water tank shown in FIG. 20.

Vest target 14*a* shown in FIG. 21 includes the motor 256 (not shown), the tank 260 (not shown) and two nozzles 262. Target 14*a* includes an aperture 169 for the target's optical system 165 (not shown) and a speaker 60 (not shown) as described above for target 14. The speaker, motor, tank and pump may be positioned and mounted in any suitable manner, and the exact location and mounting configuration are not critical. Loops 25 are provided for attaching straps (not shown) to the target 14*a* so it may be worn on the chest or back.

FIG. 22 schematically shows the electrical circuit 252 and the motor 256. The electrical circuit 252 may be essentially identical to electrical circuit 38 in FIG. 8, with the motor 256 replacing the lamp 62. The controller 40 may be programmed and to drive the motor 256 a short time (e.g., 1–2 sec.) each time a hit is detected, in place of lighting the lamp 62, and drive the motor 256 for a longer period of time (e.g., 10 secs.) when a predetermined number of hits, e.g., 10, are detected signifying that a game is over. If desired, a controller 40 may be provided having an output to drive a lamp and to also drive a motor 256. The on-off switch 92*a* is a double pole, single throw switch which couples two batteries to electrical circuit 252, a 3 v battery for the electrical circuit components and a 6 v battery for the motor 256. The transistor 90*a* is selected to handle the current needed to drive the motor 256. The electrical circuit 252 may otherwise operate as described for circuit 38.

FIG. 23 shows the electrical circuit 26 for an auxiliary target 42*a* similar to circuit 42 but including an electrical motor 256 in place of lamp 62. Power for the motor 256 is supplied from the main vest target 14*a*, which includes the extra battery for the motor circuit described above and the switch 92*a*. Where an auxiliary vest target 42*a* with a motor 256 is used with a main vest target 14 (which does not have a motor), a battery is provided either in the main vest target 14 or in the auxiliary target for the motor, and a switch is provided in either unit for the battery for the motor. The auxiliary target 42*a* with a motor, water tank and nozzle may be similar in appearance and configuration to target 14*a*.

Figure 24:
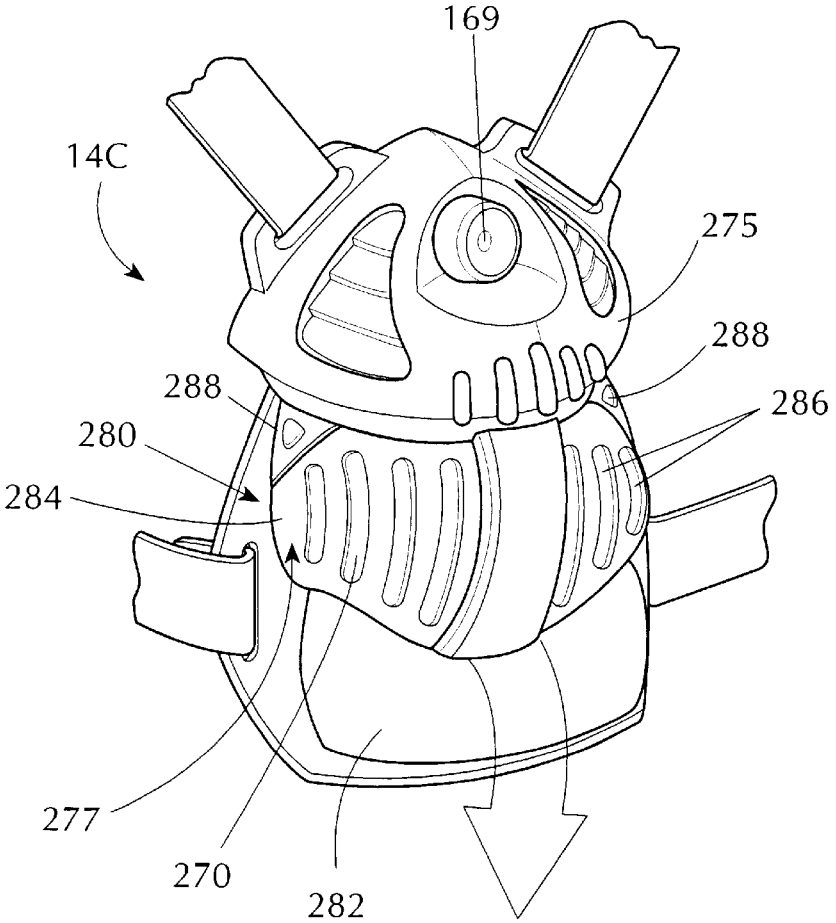
FIG. 24 is a perspective view of a vest target similar to the one shown in FIG. 4 which includes a water filled balloon and a mechanism for puncturing the balloon.
Figure 25:
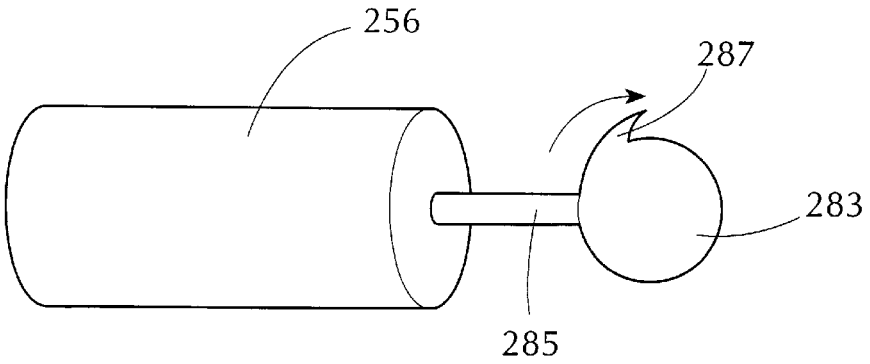
FIG. 25 is a perspective view of a mechanism carried in the target of FIG. 24 which punctures a water-filled balloon in the target.

Instead of water being squirted from a target, it may be released by puncturing a water-filled balloon. The vest target 14*c* shown in FIGS. 24 and 25 includes a balloon 270 (FIG. 24), a motor (FIG. 25) and the mechanism 272 (FIG. 25) for bursting the balloon. The electrical circuit for target 14*c* is essentially identical to electrical circuit 252, except for programming of controller 40 and the specific motor 256, and therefore is not shown. The controller 40 is programmed to drive the motor 256 only after a given number of hits is detected, signifying that the game is over, so that the balloon would be punctured only when the game was over.

The target 14*c* (FIG. 24) includes an aperture 169 for the optical system 165 (not shown in FIG. 24) and a speaker (not shown in FIG. 24) generally positioned in an upper section 275 of the target 14*c*, the exact position and mounting of which are not critical. The lower section 277 of the target 14*c* includes a receptacle 280 for the balloon 270, and a base 282 in which the motor 256 and a cam mechanism 272 (FIG. 25) are mounted. The lower section 277 includes a hinged door 284 having openings 286 therein through which water from a burst balloon is released. Locking tabs 288 hold the door 284 in the closed position shown. The door 284 is opened by pressing tabs 288 to pivot the door downwardly in the direction of the arrow to permit loading of a new water-filled balloon in the receptacle 280.

The cam mechanism 272 (FIG. 25) includes a cam 283 mounted to the shaft 285 of the motor 256. The cam 283 carries a sharp burr or spike 287 which when rotated into the water filled balloon 270 punctures it. As mentioned above, the motor 256 is driven only when a predetermined number of hits is detected. Alternatively, the motor 256 may be driven each time a hit is detected, but the cam is constructed so that the burr or spike 287 only contacts the balloon when a game-over condition is present. For example, the cam may be mounted on another shaft coupled to the motor shaft by gears.

Figure 26:
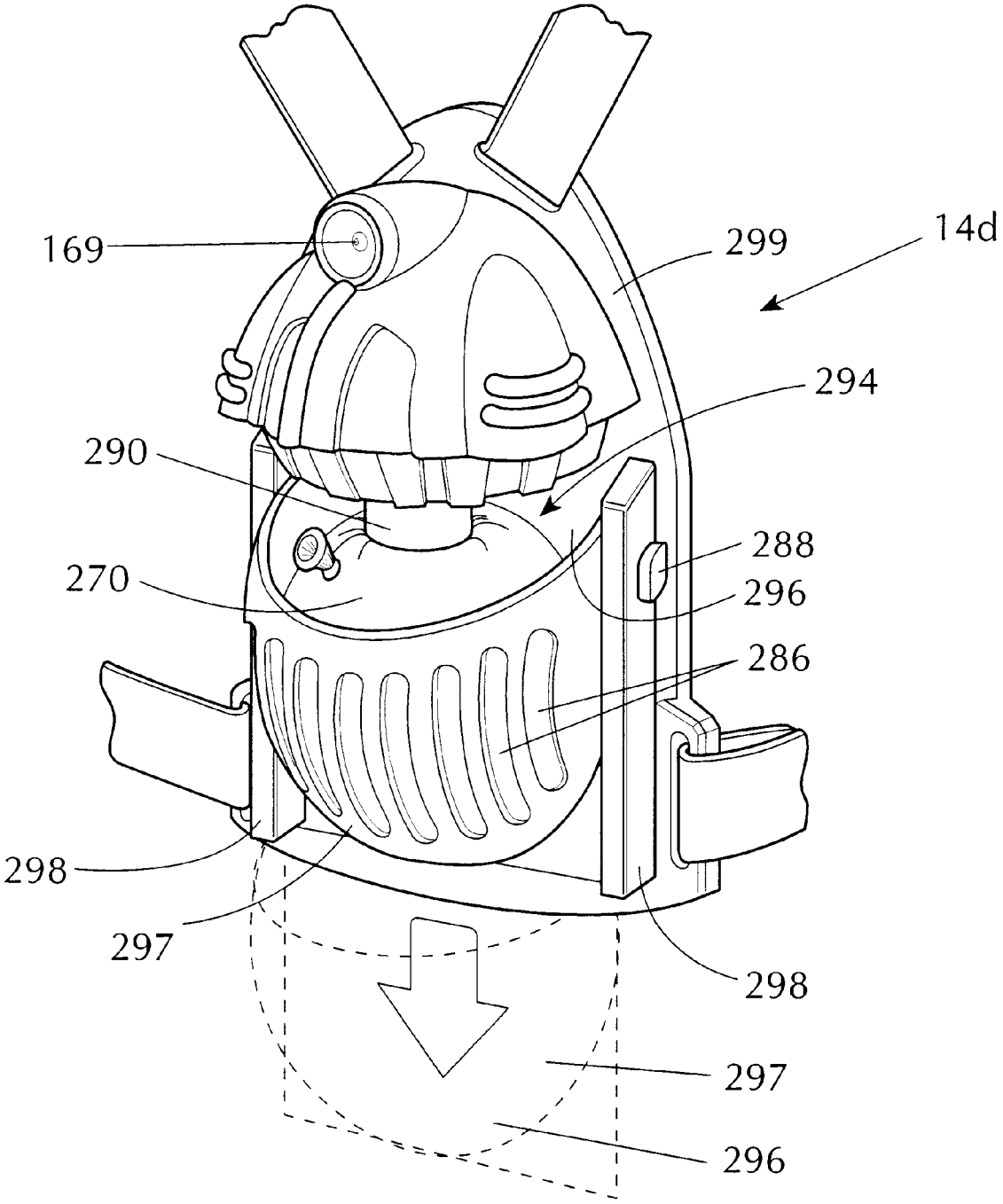
FIG. 26 is a perspective view of another embodiment of a vest target which carries a water-filled balloon.
Figure 27:
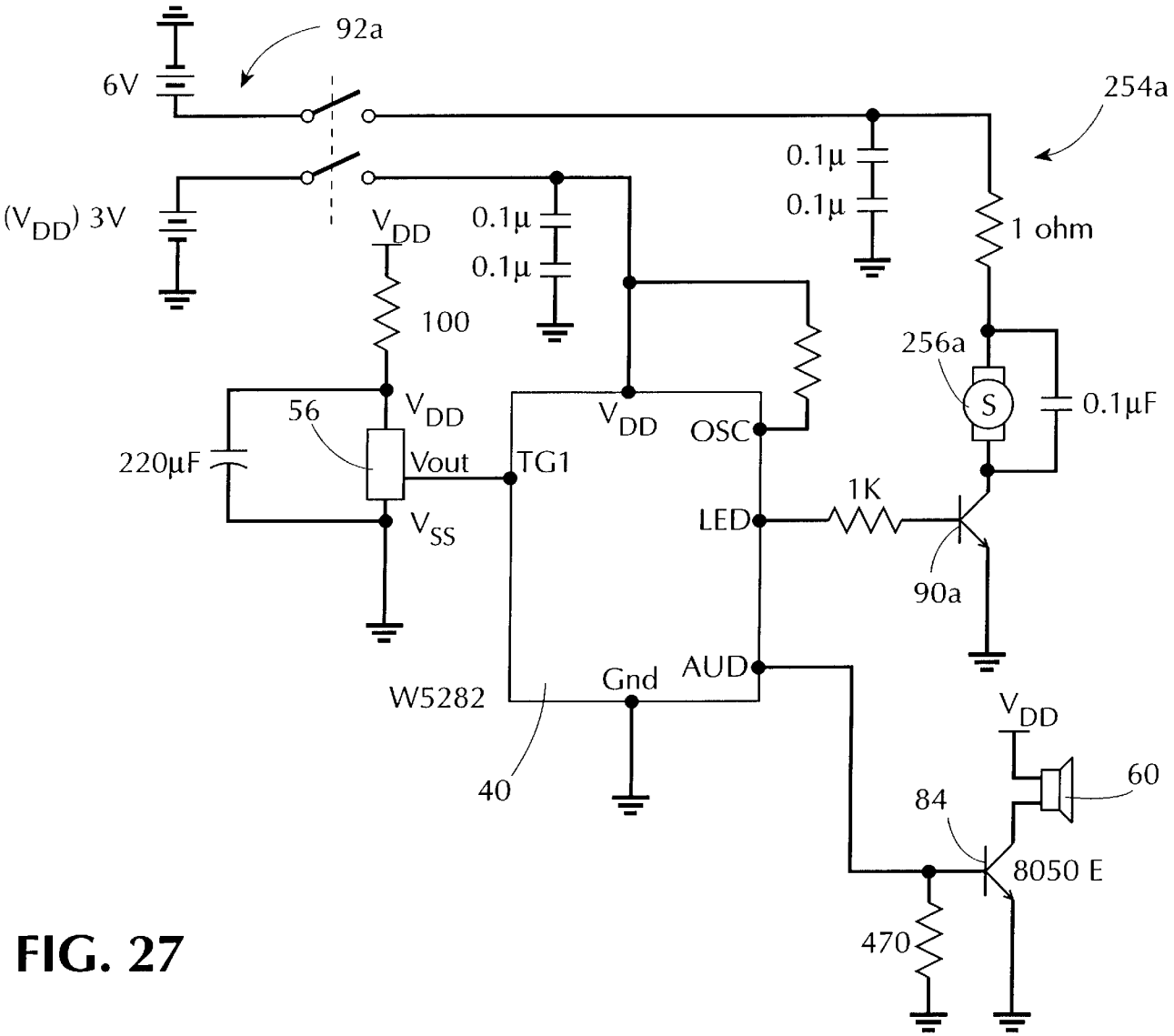
FIG. 27 is an electrical schematic diagram of the electrical circuit for the vest target of FIG. 26.

An alternative embodiment of the target 14*d* is shown in FIGS. 26 and 27, in which the motor 256 is replaced by a solenoid or electromagnet or 256*a* (FIG. 27) having a plunger 290 (FIG. 26) which carries a spike (not shown). The solenoid 256*a* is energized after a given number of hits to drive the spike into the balloon and burst it. Circuit 254*a* (FIG. 27) is essentially the same as circuit 254 except for solenoid 256*a*. The solenoid 256*a* is mounted in the upper part of target 14*d*, with the plunger 290 thereof extending downwardly into a balloon receptacle 294 in the lower part, which includes a water filled balloon 270. The receptacle 294 is formed by a rear panel 296 and a sliding door 297 with openings 286 therein for water from a burst balloon to pass therethrough. Tabs 288 mounted to the opposed upper sides of the door 298 engage holes in respective opposed tracks 297 attached to the rear wall 299 of the target 14*d* to allow the receptacle 294 to slide into the broken-line position so that a new water-filled balloon can be inserted therein. The target 14*d* is otherwise constructed and operates as generally described for targets 14*c* and 14.

While the invention has been described and illustrated in connection with preferred embodiments, many variations and modifications, as will be evident to those skilled in this art, may be made without departing from the spirit and scope of the invention. For example, the modifications mentioned in Ser. No. 08/765,895 may be made, and other types of targets having a physical output may be provided The invention as set forth in the appended claims is thus not to be limited to the precise details of construction set forth above as such variations and modifications are intended to be included within the spirit and scope of the invention as defined in the appended claims.

We claim:

1. A toy shooting game comprising:

a toy radiation projector which projects radiation therefrom generally along a direction in which the radiation projector is pointed;

a toy target adapted to be carried by a player, including a radiation detector which detects radiation projected from the radiation projector substantially only generally along a line of sight from the radiation projector to the radiation detector and provides some indication that the radiation detector has detected radiation from the radiation projector; and a device coupled to the radiation detector and adapted to be carried by a player therewith which is caused by the radiation detector to release or eject a material in response to detection of the projected radiation by the radiation detector.

2. The toy shooting game of claim 1 wherein the radiation detector causes the device to release or eject the material each time that the radiation detector detects radiation.

3. The toy shooting game of claim 1 wherein the radiation detector causes the device to release or eject the material after the radiation detector detects radiation a predetermined number of times.

4. The toy shooting game of claim 1 wherein the material is a liquid and wherein the device comprises an electric motor energized when the radiation detector detects the projected radiation, a pump driven by the electric motor, a liquid storage tank communicated with an input of the pump and a nozzle communicated with an output of the pump.

5. The toy shooting game of claim 1 wherein the material is a liquid and wherein the device comprises an electric motor energized when the radiation detector detects the projected radiation, a balloon containing the liquid, and a spiked structure coupled to the electric motor positioned to contact and rupture the balloon when moved by the electric motor.

6. The toy shooting game of claim 1 wherein the material is a liquid and wherein the device comprises a solenoid energized when the radiation detector detects the projected radiation, a balloon containing the liquid carried by the radiation detector, and a plunger coupled to the solenoid positioned to contact and rupture the balloon when moved by the solenoid.

7. The toy shooting game of claim 1 wherein the target comprises a housing adapted to be carried by a player and which carries the detector and the device.

8. The toy shooting game of claim 7 wherein the housing is adapted to be worn by a player.

9. A player-carried light detecting toy target which releases or ejects a liquid in response to detection of light having a predetermined characteristic projected from a light projector substantially only generally along a line of sight from the light projector to said target, comprising:

a housing adapted to be carried by a player and having a light transmitting aperture;

a light detector carried by said housing positioned to receive light entering said aperture which has said predetermined characteristic transmitted by the light projector substantially generally only along a line of sight from the light projector to said detector, and in response thereto providing an electrical signal; and a device coupled to said detector and adapted to being carried by a player with said housing which releases or ejects the liquid in response to said electrical signal.

10. The toy target of claim 9 wherein said detector provides said electrical signal each time that said detector detects light projected from the light projector.

11. The toy target of claim 9 wherein said detector provides said electrical signal when said detector detects light projected from the light projector a predetermined number of times.

12. The toy target of claim 9 wherein said device comprises an electric motor responsive to said electrical signal, a pump driven by said electric motor, a liquid storage tank communicated with an input of said pump and a nozzle communicated with an output of said pump.

13. The toy target of claim 9 wherein said device comprises an electric motor responsive to said electrical signal, a balloon containing the liquid carried by said detector, and a spiked structure coupled to said motor positioned to contact and rupture said balloon when moved by said motor.

14. The toy target of claim 9, wherein said device comprises a solenoid energized in response to said electrical signal, a balloon containing the liquid carried by said detector, and structure coupled to said solenoid positioned to contact and rupture said balloon when moved by said solenoid.

15. The target toy of claim 9 wherein said detector comprises an infrared light detector.

16. The target toy of claim 15 wherein said characteristic is amplitude modulation of infrared light at a given frequency.

17. The target of claim 9 wherein said housing carries said device.

18. The target of claim 17 wherein said housing is adapted to be worn by a player.

19. The combination of a main light detecting toy target and an auxiliary light detecting toy target adapted to being carried by a player playing a light shooting game, said main target and said auxiliary target each comprising a light detector positioned to receive light projected thereat and provide an output signal in response to received light having a predetermined characteristic, and a connector;

said light detector of said main target comprising an electrical circuit coupled thereto to receive and process said output signal therefrom;

said connector in said main target being coupled to said electrical circuit and said connector in said auxiliary target being coupled to receive said output signal of said light detector in said auxiliary target;

said combination further comprising a conductor connected to said connectors which couples said output signal of said light detector in said auxiliary target to said electrical circuit in said main target;

and wherein at least one of said targets includes a device coupled to the respective detector which releases or ejects a material in response to said output signal.

20. The combination of claim 19 wherein said material is a liquid, and wherein said device comprises a liquid reservoir and means for releasing or ejecting liquid from said reservoir in response to said electrical signal.

21. The combination of claim 19 wherein said targets are adapted to be worn by a player.

22. A toy shooting game comprising a toy light projector and a toy target, said toy light projector comprising:

a light source positioned to project light therefrom substantially along the direction in which said light source is pointed;

an electrical circuit coupled to said light source which energizes said light source to emit pulses of light having a given characteristic;

a manually actuatable control coupled to said electrical circuit;

said electrical circuit energizing said light source in response to activation of said control and in response thereto said light source emitting light having said given characteristic;

said target being adapted to be carried by a player and comprising:

a light detector positioned to receive light projected thereat having said predetermined characteristic transmitted by said light projector substantially generally only along a line of sight from said light projector to said detector, and in response thereto providing an electrical signal; and a device coupled to said detector which releases or ejects a material in response to said electrical signal.

23. The toy shooting game of claim 22 wherein said light source emits infrared light when energized by said electrical circuit.

24. The toy shooting game of claim 23 wherein said electrical circuit of said toy light projector comprises a modulating circuit which modulates energization of said light source during a first time period in response to activation of said control.

25. The toy shooting game of claim 24 wherein said modulating circuit modulates energization of said light source at a fixed frequency.

26. The toy shooting game of claim 22 wherein said material is a liquid, and wherein said device comprises a liquid reservoir and means for releasing or ejecting liquid from said reservoir in response to said electrical signal.

27. The target of claim 22 wherein said target is adapted to be worn by a player.

* * * * *